US012677915B2

(12) United States Patent
Yuan et al.

(10) Patent No.: US 12,677,915 B2
(45) Date of Patent: Jul. 14, 2026

(54) WATCHBAND CLASP, WATCHBAND, AND WEARABLE DEVICE

(71) Applicant: HUAWEI TECHNOLOGIES CO., LTD., Shenzhen (CN)

(72) Inventors: Shenglan Yuan, Dongguan (CN); Bin Zhang, Dongguan (CN); Tianyu Cheng, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 424 days.

(21) Appl. No.: 18/016,744

(22) PCT Filed: Jul. 19, 2021

(86) PCT No.: PCT/CN2021/107169
§ 371 (c)(1),
(2) Date: Jan. 18, 2023

(87) PCT Pub. No.: WO2022/017332
PCT Pub. Date: Jan. 27, 2022

(65) Prior Publication Data

US 2023/0309664 A1 Oct. 5, 2023

(30) Foreign Application Priority Data

Jul. 22, 2020 (CN) ..... 202010710813.5

(51) Int. Cl.
*A44C 5/24* (2006.01)
*A44C 5/14* (2006.01)
*A44C 5/16* (2006.01)

(52) U.S. Cl.
CPC ..... *A44C 5/16* (2013.01); *A44C 5/145* (2013.01); *A44C 5/24* (2013.01)

(58) Field of Classification Search
CPC ..... A44B 11/2519; A44B 11/266; Y10T 24/4782; A44C 5/24; A44C 5/243; A44C 5/246; A44C 5/16; A44C 5/145
See application file for complete search history.

(56) References Cited

U.S. PATENT DOCUMENTS 5,305,503 A * 4/1994 Yamagata ..... A44C 5/24 24/71 J
5,313,691 A * 5/1994 Hashimoto ..... A44C 5/2052 24/69 J (Continued)

FOREIGN PATENT DOCUMENTS

CH 698981 B1 12/2009
CH 701806 A2 * 3/2011 ..... A44C 5/24

(Continued)

*Primary Examiner* — Jason W San
*Assistant Examiner* — Anna S Rashid

(57) ABSTRACT

This application discloses a watchband clasp, a watchband, and a wearable device. The watchband clasp (1000) includes a first fastener (1), a second fastener (2) rotatably mounted on the first fastener (1), a cover plate (3) rotatably mounted at an end that is of the second fastener (2) and that is away from the first fastener (1), a hook member (4) slidably mounted on the cover plate (3), and an elastic member (5) mounted between the cover plate (3) and the hook member (4). The elastic member (5) can enable the hook member (4) to maintain a clamped state with an inner wall of a hook hole (11). The cover plate (3) is provided with a first accommodation slot (35) used to accommodate the first fastener (1) and the second fastener (2).

15 Claims, 20 Drawing Sheets

(56) References Cited

U.S. PATENT DOCUMENTS 5,485,659 A * 1/1996 Kashikie ..... A44C 5/246 24/71 J
6,308,382 B1 * 10/2001 Takahashi ..... A44C 5/24 24/71 J
6,681,453 B1 * 1/2004 Hashimoto ..... A44C 5/246 24/71 J
7,574,785 B1 * 8/2009 Chen ..... A45C 13/30 383/70
10,827,807 B2 * 11/2020 Li ..... G04B 37/1486
2004/0083581 A1 * 5/2004 Kawagoe ..... A44C 5/185 24/265 WS
2004/0168469 A1 * 9/2004 Tetu ..... A44C 5/24 63/3
2007/0266746 A1 * 11/2007 Yu ..... E05B 35/08 70/69
2007/0271740 A1 * 11/2007 Yamamoto ..... A44C 5/246 24/265 WS
2009/0049667 A1 * 2/2009 Takahashi ..... A44C 5/246 24/71 J
2014/0150495 A1 * 6/2014 Kaltenrieder ..... A44C 5/246 63/3.2
2014/0366339 A1 * 12/2014 Haering ..... A44C 5/24 24/265 B
2015/0181988 A1 * 7/2015 Kaltenrieder ..... A44C 5/24 24/69 J
2015/0366303 A1 * 12/2015 Pier ..... A44C 5/246 24/71 J
2018/0242697 A1 * 8/2018 Webb ..... A44C 5/107
2019/0000194 A1 * 1/2019 Lazenby ..... A44C 5/003
2019/0350319 A1 * 11/2019 Li ..... A44C 5/145
2020/0113295 A1 * 4/2020 Yang ..... A44C 5/24
2023/0000219 A1 * 1/2023 Yamashita ..... A44C 5/246
2023/0309664 A1 * 10/2023 Yuan ..... A44C 5/145 224/168

FOREIGN PATENT DOCUMENTS

CN 1304292 A * 7/2001 ..... A44C 5/2052
CN 105899098 A * 8/2016 ..... A44C 5/246
CN 207055005 U * 3/2018
CN 208192384 U * 12/2018
CN 110096098 A * 8/2019 ..... G06F 1/163
CN 209473799 U * 10/2019
CN 209711779 U * 12/2019
EP 0914781 A1 * 5/1999
JP H09187310 A * 7/1997
JP 2004097659 A * 4/2004
JP 3172899 U * 1/2012
WO WO-2006079605 A1 * 8/2006 ..... A44B 11/16

* cited by examiner

WATCHBAND CLASP, WATCHBAND, AND WEARABLE DEVICE

CROSS-REFERENCE TO RELATED APPLICATIONS

This application is a National Stage of International Application No. PCT/CN2021/107169, filed on Jul. 19, 2021, which claims priority to Chinese Patent Application No. 202010710813.5, filed on Jul. 22, 2020. Both of the aforementioned applications are hereby incorporated by reference in their entireties.

TECHNICAL FIELD

This application relates to the field of wrist wearable devices, and in particular, to a watchband clasp, a watchband, and a wearable device.

BACKGROUND

A wrist wearable device, such as a watch and a wrist band, usually has a watchband to be worn on a wrist. A conventional watchband is fixedly worn on a wrist through a watchband clasp. However, as shown in FIG. 1, the watchband clasp on the conventional watchband of a watch has a protrusion 9 pointing to the wrist. Therefore, the protrusion 9 is against the wrist during wearing, affecting wearing comfort.

SUMMARY

Embodiments of this application provide a watchband clasp, a watchband, and a wearable device, to resolve a problem that wearing comfort is affected when a watchband clasp has a protrusion against a wearer's wrist.

To resolve the foregoing problem, the following technical solutions are used in embodiments of this application.

According to a first aspect, a watchband clasp is provided, including a first fastener, a second fastener rotatably mounted on the first fastener, a cover plate rotatably mounted at an end that is of the second fastener and that is away from the first fastener, a hook member slidably mounted on the cover plate, and an elastic member mounted between the cover plate and the hook member. The cover plate is provided with a first accommodation slot used to accommodate the first fastener and the second fastener. The first fastener is provided with a hook hole adapted to the hook member. The elastic member can enable the hook member to maintain a clamped state with an inner wall of the hook hole.

The first fastener and the cover plate are separately rotatably connected to two opposite ends of the second fastener. When the watchband clasp is in a locked state, the first fastener and the cover plate each rotate a specific angle relative to the second fastener, so that the first fastener, the second fastener, and the cover plate are stacked together. In this case, the hook member slidably mounted on the cover plate extends into the hook hole on the first fastener, and is clamped to the inner wall of the hook hole. Therefore, neither the first fastener nor the cover plate can rotate relative to the second fastener, and the locked state of the watchband clasp is implemented. Because the elastic member is disposed between the cover plate and the hook member, the elastic member may restrict sliding of the hook member relative to the cover plate, so that the hook member remains clamped to the inner wall of the hook hole.

Therefore, in the locked state of the watchband clasp, that is, in a normal use state of the watchband clasp, the first fastener, the second fastener, and the cover plate are stacked together, and the second fastener is located between the first fastener and the cover plate. In this case, a surface on a side that is of the first fastener and that is away from the cover plate is in contact with skin at the wrist. The hook member slidably mounted on the cover plate extends into the hook hole on the first fastener through a surface on a side that is of the first fastener and that faces the cover plate, and is clamped to the inner wall of the hook hole, so that the cover plate and the first fastener are fastened to each other. Therefore, the hook member does not protrude from the surface on the side that is of the first fastener and that is away from the cover plate, that is, the first fastener that is in contact with the skin at the wrist has no protrusion structure. Wearing comfort is not likely to be affected by a protrusion structure against the skin at the wrist.

When the first fastener, the second fastener, and the cover plate are stacked together, and the second fastener is located between the first fastener and the cover plate, a principle in which the hook member that is slidably mounted on the cover plate cooperates with the hook hole on the first fastener includes the following manners. In one manner, a width of the second fastener is set to be less than a width of the first fastener, and the hook member is disposed outside a boundary range of the second fastener. Therefore, the second fastener does not block the hook member, and the hook member can extend into the hook hole on the first fastener. In another manner, a through hole corresponding to the hook member is disposed on the second fastener, and the hook member penetrates through the through hole on the second fastener and extends into the hook hole on the first fastener.

When the locked state of the watchband clasp needs to be released, a finger may exert a force on the hook member and overcome a reaction force exerted by the elastic member, to drive the hook member to slide relative to the cover plate, and release the clamped state between the hook member and the inner wall of the hook hole. This operation manner is relatively convenient.

For the watchband clasp provided in this embodiment of this application, when the watchband clasp is used as a part of a watchband, and is applied to a wearable device, such as a watch and a wristband, in a state in which the wearable device is worn on a wrist, the surface on the side that is of the first fastener and that is away from the cover plate is in contact with the skin at the wrist. The cover plate is provided with the first accommodation slot used to accommodate the first fastener and the second fastener. When the watchband clasp is in the locked state, and the first fastener, the second fastener, and the cover plate are stacked together, the first fastener and the second fastener can be completely located in the first accommodation slot on the cover plate. On the premise that the first fastener and the second fastener are located inside the cover plate, the hook member slidably mounted on the cover plate remains clamped to the inner wall of the hook hole on the first fastener under the action of the elastic member, so that the cover plate and the first fastener are fastened to each other. In addition, the hook member does not protrude from the surface on the side that is of the first fastener and that is away from the cover plate, that is, the first fastener that is in contact with the skin at the wrist has no protrusion structure. Wearing comfort is not likely to be affected by a protrusion structure against the skin at the wrist.

In an embodiment, the hook member includes a sliding plate slidably mounted on the cover plate and a first hook connected to the sliding plate, a limiting part movably connected to the first hook is disposed in the hook hole, and the limiting part can restrain the first hook from leaving the hook hole in a depth direction of the hook hole.

In an embodiment, the limiting part is a second hook adapted to the first hook. Alternatively, the limiting part is a clamping hole disposed on the inner wall of the hook hole and adapted to the first hook.

A manner of implementing clamping between the hook member and the inner wall of the hook hole may be as follows:

In one manner, the first hook of the hook member extends into the hook hole and is clamped to the second hook on the inner wall of the hook hole. Under the action of the elastic member, the sliding plate slides and drives the first hook to maintain a reverse clamped state with the second hook. In this case, the first hook cannot move relative to the first fastener in an axial direction of the hook hole, and this limits rotation of the cover plate relative to the first fastener, so that the watchband clasp remains in the locked state.

In another manner, the first hook of the hook member extends into the hook hole, and under the action of the elastic member, the sliding plate slides and drives the first hook to be inserted into the clamping hole on the inner wall of the hook hole. In this case, the first hook abuts against an inner wall of the clamping hole and cannot move relative to the first fastener in an axial direction of the hook hole, and this limits rotation of the cover plate relative to the first fastener, so that the watchband clasp remains in the locked state.

In an embodiment, the cover plate is provided with a sliding slot, the hook member is slidably mounted in the sliding slot, an inner wall of the sliding slot is provided with a spacing hole, the hook member further includes a connection plate connected between the first hook and the sliding plate, the connection plate penetrates through the spacing hole, and an included angle between the first hook and the connection plate ranges from 85 degrees to 95 degrees (the included angle may be 90 degrees or approximately 90 degrees).

The hook member is slidably mounted in the sliding slot on the cover plate, so that most of the hook member is located inside the cover plate. This implements miniaturization of the watchband clasp. In addition, the inner wall of the sliding slot may limit a plurality of places on the hook member, to cooperate with the elastic member to slidably mount the hook member on the cover plate stably. When an external force drives the hook member to slide, the hook member is not prone to detach from the cover plate.

The hook member further includes the connection plate connected between the first hook and the sliding plate. When the hook member slides, the sliding plate serving as a main body of sliding slides relative to the cover plate, and drives the connection plate and the first hook to move. Because the included angle between the first hook and the connection plate ranges from 85 degrees to 95 degrees (the included angle may be 90 degrees or approximately 90 degrees), when the first hook extends into the hook hole, the connection plate may be located outside the hook hole. Therefore, when an external force drives the hook member to move in a direction perpendicular to the axial direction of the hook hole, the clamped state between the first hook and the inner wall of the hook hole can be released, so that the cover plate may rotate relative to the first fastener, to release the locked state of the watchband clasp. For example, the reverse clamped state between the first hook and the second hook is released. Alternatively, the first hook is driven to leave the clamping hole on the inner wall of the hook hole, so that the clamped state between the first hook and the inner wall of the clamping hole is released.

The inner wall of the sliding slot is provided with the spacing hole, and the connection plate penetrates through the spacing hole. Therefore, the spacing hole may be used as a guide structure in which the connection plate slides with the sliding plate, so that the connection plate can move in only an axial direction of the spacing hole. When the hook member is pressed by an external force, even if the applied force is not completely parallel to the axial direction of the spacing hole, the connection plate may still be limited by the spacing hole, so that the hook member integrally slides in the axial direction of the spacing hole.

In an embodiment, the cover plate has a front face facing the second fastener, a rear face facing back to the second fastener, and a side face connected between the front face and the rear face. The sliding slot is disposed on the rear face or the side face.

When the watchband clasp is in the locked state, and the first fastener, the second fastener, and the cover plate are stacked together, the cover plate has the front face facing the second fastener, the rear face facing back to the second fastener, and the side face connected between the front face and the rear face.

In an embodiment, the sliding slot may be disposed on the rear face. When the hook member is slidably mounted in the sliding slot on the rear face, even if the hook member does not protrude from the rear face, a user can still exert a force on the hook member, to drive the hook member to slide relative to the cover plate. In this case, the watchband clasp has no protrusion structure in a position in contact with the skin, and the watchband clasp almost has no protrusion structure in a position away from the skin, so that compactness of the structure of the watchband clasp is implemented.

In another embodiment, the sliding slot may be disposed on the side face. The hook member may slightly protrude from the side face, so that an external force can be exerted by a finger. In this case, the rear face of the cover plate is in a complete state, and has good aesthetics. In addition, a corresponding pattern may be disposed on the rear face of the cover plate, to further improve aesthetics and achieve a good design effect.

In an embodiment, the front face of the cover plate is provided with the first accommodation slot. The spacing hole is connected to the first accommodation slot.

When the watchband clasp is in the locked state, and when the first fastener, the second fastener, and the cover plate are stacked together, the second fastener may be completely located in the first accommodation slot on the cover plate, and most of the second fastener is located in the first accommodation slot. This further implements compactness of the structure of the watchband clasp. In addition, surfaces of the second fastener and the cover plate may be approximately flush. This can further improve comfort of contact between the watchband clasp and the skin at the wrist.

The spacing hole is connected to the first accommodation slot. Therefore, the connection plate of the hook member can extend into the first accommodation slot, that is, movement of the first hook driven by the connection plate also occurs in the first accommodation slot, so that a state in which the first hook slides is hidden inside the watchband clasp.

In an embodiment, first rotation holes are disposed on two opposite inner walls of the first accommodation slot, the second fastener is provided with a second rotation hole, a first rotating connection shaft is disposed between the second fastener and the cover plate, the first rotating connection shaft penetrates through the second rotation hole, and two opposite ends of the first rotating connection shaft are separately rotatably mounted in the two first rotation holes.

The first rotating connection shaft penetrates through the second rotation hole on the second fastener, and the two opposite ends of the first rotating connection shaft are separately rotatably mounted in the two first rotation holes. Because the two first rotation holes are separately disposed on the two opposite inner walls of the first accommodation slot, the second fastener is rotatably mounted on the inner wall of the first accommodation slot on the cover plate through the first rotating connection shaft. After rotating relative to the cover plate, the second fastener may integrally rotate into the first accommodation slot, and may be hidden in the cover plate, to implement compactness of the structure of the watchband clasp.

In an embodiment, the second fastener has a rotation cylinder, the rotation cylinder is provided with the second rotation hole, and the first fastener is provided with a second accommodation slot adapted to the rotation cylinder.

The first accommodation slot on the cover plate may be used to accommodate the first fastener and the second fastener. In some embodiments, a width of the second fastener is less than a width of the first fastener, and the rotation cylinder may be disposed on the second fastener to implement a rotatable connection between the second fastener and the cover plate. A length of the rotation cylinder is greater than the width of the second fastener, but slightly less than a width of the first accommodation slot (a width in an axial direction of the rotation cylinder). Therefore, the inner wall that is of the first accommodation slot and that is provided with the first rotation hole may indirectly limit the second fastener by limiting two opposite ends of the rotation cylinder, so that the second fastener can move relative to the cover plate mainly through only rotation of the first rotating connection shaft.

Optionally, the first fastener is provided with the second accommodation slot that is used to accommodate a part that is of the rotation cylinder and that protrudes from the surface of the second fastener. In this way, after the first fastener rotates a specific angle relative to the second fastener, existence of the rotation cylinder does not cause a large gap between the first fastener and the second fastener.

In an embodiment, the first fastener is provided with an accommodation hole used to accommodate the second fastener, and a depth of the accommodation hole is greater than or equal to a thickness of the second fastener.

The accommodation hole on the first fastener is greater than or equal to the thickness of the second fastener. After the second fastener rotates relative to the first fastener, the second fastener may approximately be integrally located in the accommodation hole. When the first fastener, the second fastener, and the cover plate are stacked together, a depth of the first accommodation slot on the cover plate needs only to match a thickness of the first fastener. This reduces a thickness of the watchband clasp in the locked state.

In an embodiment, third rotation holes are disposed on two opposite inner walls of the accommodation hole, a fourth rotation hole is disposed on the second fastener, a second rotating connection shaft is disposed between the first fastener and the second fastener, the second rotating connection shaft penetrates through the fourth rotation hole, and two opposite ends of the second rotating connection shaft are separately rotatably mounted in the two third rotation holes.

The second rotating connection shaft penetrates through the fourth rotation hole on the second fastener, and the two opposite ends of the second rotating connection shaft are separately rotatably mounted in the two third rotation holes. Because the two third rotation holes are separately disposed on the two opposite inner walls of the accommodation hole, the second fastener is rotatably mounted on the inner wall of the accommodation hole of the first fastener through the second rotating connection shaft. After rotating relative to the first fastener, the second fastener may integrally rotate into the accommodation hole, and may be hidden in the first fastener, to implement compactness of the structure of the watchband clasp. In addition, because the second fastener is integrally hidden in the first fastener, when the first fastener, the second fastener, and the cover plate are stacked together, a depth of the first accommodation slot on the cover plate needs only to match a thickness of the first fastener. This reduces a thickness of the watchband clasp in the locked state.

In an embodiment, the inner wall of the sliding slot is provided with a limiting waist-type hole, a threaded hole is disposed on the hook member, and a limiting screw is disposed between the hook member and the cover plate. The limiting screw penetrates through the limiting waist-type hole and is threadedly connected to the threaded hole. A length and a width of the limiting waist-type hole are greater than an outer diameter of the limiting screw; and an included angle between an axis of the limiting waist-type hole and an axis of the spacing hole ranges from 85 degrees to 95 degrees.

The connecting screw penetrates through the limiting waist-type hole on the inner wall of the sliding slot, and is threadedly connected to the threaded hole on the hook member. The length and the width of the limiting waist-type hole are both set to be greater than the outer diameter of the limiting screw. Therefore, the hook member may drive the limiting screw to move, and two opposite inner walls in a length direction of the limiting waist-type hole may be against the limiting screw. That is, a sliding stroke of the hook member relative to the cover plate is determined by the length of the limiting waist-type hole. Therefore, when the hook member is driven to slide by an external force, the hook member is not likely to be taken away from the cover plate in a direction perpendicular to the axis of the limiting waist-type hole, and it is not prone to produce strong impact between the hook member and the inner wall of the hook hole in the direction perpendicular to the axis of the limiting waist-type hole.

The limiting screw located in the limiting waist-type hole may perform a specific limit on the hook member in the direction perpendicular to the axis of the limiting waist-type hole, and the inner wall of the spacing hole may limit the hook member in a direction perpendicular to the axis of the spacing hole. There is an included angle between the axis of the limiting waist-type hole and the axis of the spacing hole. The included angle may range from 85 degrees to 95 degrees (for example, is 90 degrees or 90±1 degrees). Therefore, the limiting screw and the spacing hole may separately perform a specific limit on the hook member in different directions, so that the hook member is slidably mounted on the cover plate stably, and is not prone to detach from the cover plate. In particular, when the axis of the limiting waist-type hole and the axis of the spacing hole are perpendicular to each other, the limiting screw may exert a specific limit on the hook member on the horizontal plane, and the inner wall of the spacing hole may limit the hook member on the vertical plane, so that the hook member is not prone to detach from the cover plate, and may be slidably mounted on the cover plate stably.

In an embodiment, the elastic member is a spring.

The elastic member is the spring. When the spring is in a natural state, the spring may restrict sliding of the hook member relative to the cover plate, so that the hook member remains clamped to the inner wall of the hook hole. In this case, the hook member cannot move relative to the first fastener in an axial direction of the hook hole, and this restricts rotation of the cover plate relative to the first fastener, so that the watchband clasp remains in the locked state.

When the locked state of the watchband clasp needs to be released, a finger may exert a force on the hook member and overcome a reaction force exerted by the spring, to drive the hook member to slide relative to the cover plate, and release the clamped state between the hook member and the inner wall of the hook hole.

For example, when the spring is a compression spring, in a process of pressing the hook member to compress the compression spring, the hook member may be driven to slide relative to the cover plate, and the clamped state between the hook member and the inner wall of the hook hole may be released.

For example, when the spring is a tension spring, in a process of pulling (plucking) the hook member to stretch the tension spring, the hook member may be driven to slide relative to the cover plate, and the clamped state between the hook member and the inner wall of the hook hole may be released.

In an embodiment, an axis of the spring may be parallel to the axis of the spacing hole. A force exerted by the spring on the connection plate (the hook member) is in the axial direction of the spacing hole, so that the force exerted by the spring on the hook member is mostly used to tightly clamp the hook member to the inner wall of the hook hole, to ensure that the watchband clasp in the locked state is relatively stable.

In an embodiment, the hook member is provided with a mounting slot, one end of the spring abuts against the bottom of the mounting slot, and the other end of the spring abuts against the cover plate.

An end of the spring is mounted in the mounting slot, to hide most of the spring inside the hook member, and implement compactness of the structure of the watchband clasp. A radial direction of the spring may further be limited, so that the spring deforms almost in only an axial direction.

In an embodiment, there is an included angle between the axis of the spring and the axis of the hook hole. The included angle may range from 85 degrees to 95 degrees (for example, is 90 degrees or 90±1 degrees).

The axis of the spring is disposed to have an included angle (for example, the included angle ranges from 85 degrees to 95 degrees) with the axis of the hook hole. Therefore, a force exerted by the spring on the hook member is not parallel to the axis of the hook hole, and the force exerted by the spring on the hook member necessarily has a component force in a direction perpendicular to the axis of the hook hole, so that the hook member can be stably clamped to the inner wall of the hook hole. For example, the first hook of the hook member may be closely attached to the second hook on the inner wall of the hook hole, to implement a reverse clamped connection, so as to ensure a good clamped state, and implement stability of the watchband clasp in the locked state. Alternatively, the first hook of the hook member may extend into the clamping hole on the inner wall of the hook hole, and be against the inner wall of the clamping hole, to ensure a good clamped state, and implement stability of the watchband clasp in the locked state.

In an embodiment, there are two hook members, and the two hook members are disposed oppositely and spaced from each other.

The two hook members are slidably mounted on the cover plate in an opposite and spaced manner. When the locked state of the watchband clasp needs to be released, the thumb and the index finger of the hand each may press one hook member, and then the thumb and the index finger exert forces in opposite directions, to drive the two hook members to move toward each other, and overcome the reaction force exerted by the elastic member, so that the elastic member deforms, to release the clamped state between the hook member and the inner wall of the hook hole.

Because the thumb and the index finger of the hand each may drive one hook member to move. Therefore, both the thumb and the index finger may move toward the center of the cover plate, and pressure exerted by the two hook members on the cover plate through the elastic member is relatively symmetrical. The cover plate is not prone to deflect and can be operated with one hand. For example, when the hook member is disposed on the side face of the cover plate, and two hook members are pressed, forces exerted by the two hook members on the cover plate through the elastic member may approximately offset each other, and the cover plate is not deflected.

The two hook members are slidably mounted on the cover plate in an opposite and spaced manner. Therefore, the two hook members may be separately clamped to inner walls of two hook holes on the first fastener. When the watchband clasp is in the locked state, the cover plate and the first fastener are connected through two symmetrically disposed hook members. When no force is exerted to drive the hook member to slide, the cover plate is not prone to move relative to the second fastener, and the watchband clasp is in a relatively stable locked state.

According to a second aspect, a watchband is provided, including the watchband clasp in any one of the foregoing embodiments.

The watchband includes the watchband clasp in any one of the foregoing embodiments. When the watchband is worn on a wrist, a surface on a side that is of a first fastener and that is away from a cover plate is in contact with skin at the wrist. A hook member slidably mounted on the cover plate extends into a hook hole on the first fastener through a surface on a side that is of the first fastener and that faces the cover plate, and is clamped to an inner wall of the hook hole, so that the cover plate and the first fastener are relatively fastened. Therefore, the hook member does not protrude from the surface on the side that is of the first fastener and that is away from the cover plate, that is, the first fastener that is in contact with the skin at the wrist has no protrusion structure. Wearing comfort is not likely to be affected by a protrusion structure against the skin at the wrist.

In an embodiment, the watchband further includes a first watchband chain connected to the first fastener, and a second watchband chain connected to the cover plate.

The first watchband chain is connected (for example, rotatably connected) to the first fastener, and the second watchband chain is connected (for example, rotatably connected) to the second fastener. The first watchband chain and the second watchband chain each may include a plurality of chain units. Neighboring chain units are rotatably connected to each other, to adapt to wearing requirements of hands with different shapes.

For a watchband in another embodiment, the first fastener and the cover plate may be connected to a leathery band or a band made of a flexible high-molecular polymer.

In an embodiment, the watchband is a metal member or a plastic member.

In an embodiment, the watchband may be a metal member, and the watchband clasp, the first watchband chain, and the second watchband chain are all metal.

In another embodiment, the watchband may be a plastic member, the watchband clasp is a rigid plastic member, and the first watchband chain and the second watchband chain may be flexible plastic members.

According to a third aspect, a wearable device is provided, including the watchband in any one of the foregoing embodiments.

The wearable device may be a device such as a watch (a conventional watch or a smart watch) or a wristband. When the wearable device is worn on a wrist, a surface on a side that is of a first fastener and that is away from a cover plate is in contact with skin at the wrist. A hook member slidably mounted on the cover plate extends into a hook hole on the first fastener through a surface on a side that is of the first fastener and that faces the cover plate, and is clamped to an inner wall of the hook hole, so that the cover plate and the first fastener are fastened to each other. Therefore, the hook member does not protrude from the surface on the side that is of the first fastener and that is away from the cover plate, that is, the first fastener that is in contact with the skin at the wrist has no protrusion structure. Wearing comfort is not likely to be affected by a protrusion structure against the skin at the wrist.

The wearable device may be a watch, and the watchband may be a metal member, which may show sense of luxury of the watch. All parts of the watchband may be processed by using a surface processing technology, to implement diversity of the appearance of the watchband.

Figure 1:
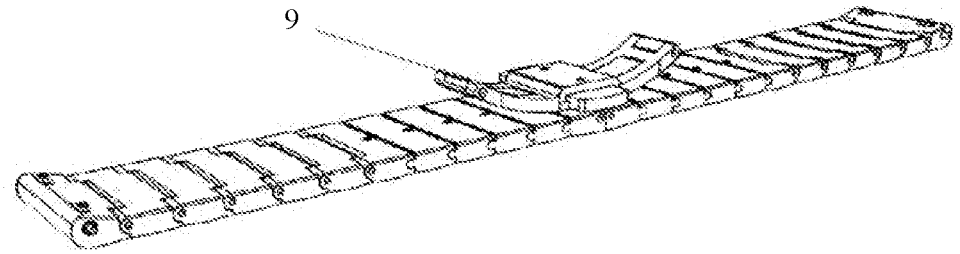
FIG. 1 is a schematic diagram of a structure of a watchband with a watchband clasp in the conventional technology.

1: first fastener; 11: hook hole; 111: second hook; 112: clamping hole; 12: second accommodation slot; 13: accommodation hole; 131: third rotation hole;

2: second fastener; 21: second rotation hole; 22: rotation cylinder; 23: fourth rotation hole;

3: cover plate; 31: sliding slot; 311: spacing hole; 312: limiting waist-type hole; 32: front face; 33: rear face; 34: side face; 35: first accommodation slot; 351: first rotation hole;

4: hook member; 41: sliding plate; 42: first hook; 43: connection plate; 44: threaded hole; 45: mounting slot;

5: elastic member; 51: spring;

6: first rotating connection shaft; 7: second rotating connection shaft; 8: limiting screw; 9: protrusion;

1000: watchband clasp; 2000: first watchband chain; 3000: second watchband chain; 4000: watchband.

DESCRIPTION OF EMBODIMENTS

To make the objectives, technical solutions, and advantages of this application clearer and more comprehensible, the following further describes this application in detail with reference to the accompanying drawings and embodiments. It should be understood that the specific embodiments described herein are merely used to explain this application but are not intended to limit this application.

It should be noted that when an element is referred to as "fastened to" or "disposed on" another element, the element may be directly or indirectly on the another element. When an element is referred to as "connected to" another element, the element may be directly or indirectly connected to the another element.

It should be understood that a direction or position relationship indicated by terms such as "length", "width", "upper", "lower", "front", "rear", "left", "right", "vertical", "horizontal", "top", "bottom", "inner", or "outer" is a direction or a position relationship shown based on the accompanying drawings, is merely used to describe this application and simplify the descriptions, but is not intended to specify or imply that an indicated apparatus or element needs to have a particular direction, needs to be constructed in a particular direction structure, and needs to be operated in a particular direction, and therefore cannot be construed as a limitation on this application.

In addition, the terms "first" and "second" are merely intended for a purpose of description, and shall not be understood as an indication or implication of relative importance or implicit indication of a quantity of indicated technical features. Therefore, a feature limited by "first" or "second" may explicitly or implicitly include one or more features. In the descriptions of this application, "a plurality of" means two or more than two, unless otherwise specifically limited.

A watchband clasp provided in embodiments of this application may be applied to a wearable device with a watchband, such as a watch and a wristband. In specific application, after the wearable device is worn on a wrist through the watchband, the wearable device may be stably worn on the wrist by locking the watchband clasp. After a locked state of the watchband clasp is released, the wearable device may be removed from the wrist.

First, with reference to FIG. 2 to FIG. 10, Embodiment 1 of a watchband clasp 1000 in this application is described in detail.

Figure 2:
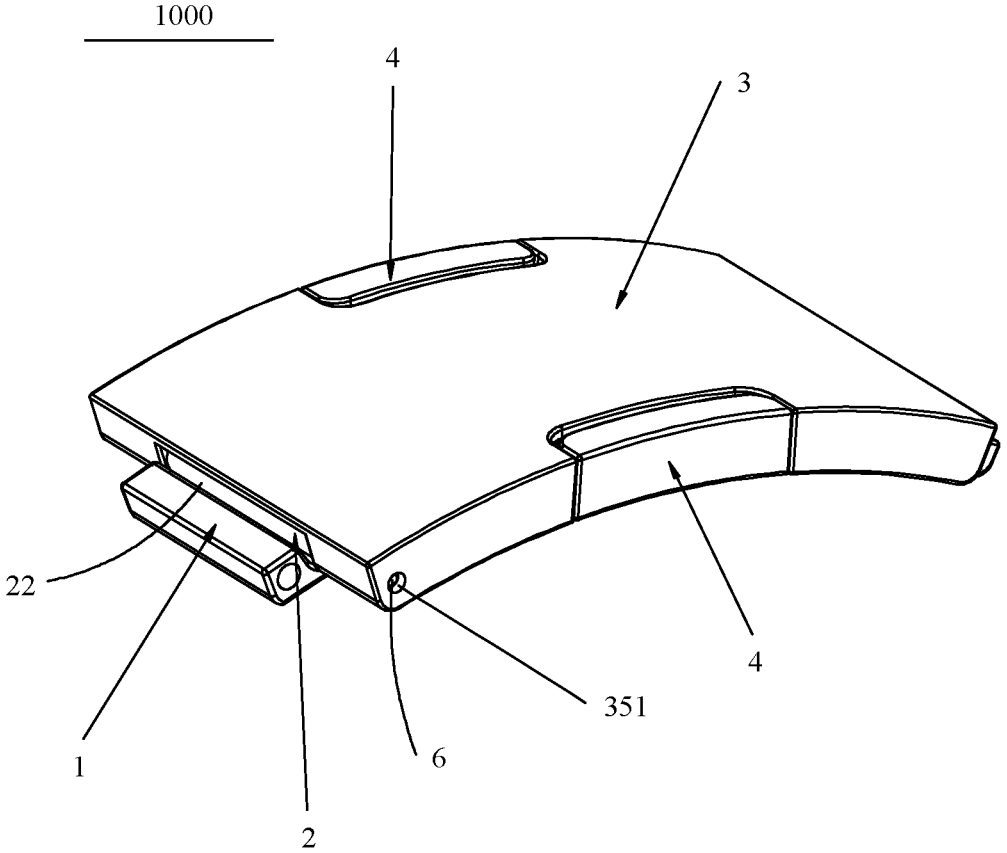
FIG. 2 is a schematic diagram of a structure of a watchband clasp in a locked state according to Embodiment 1 of this application.
Figure 3:
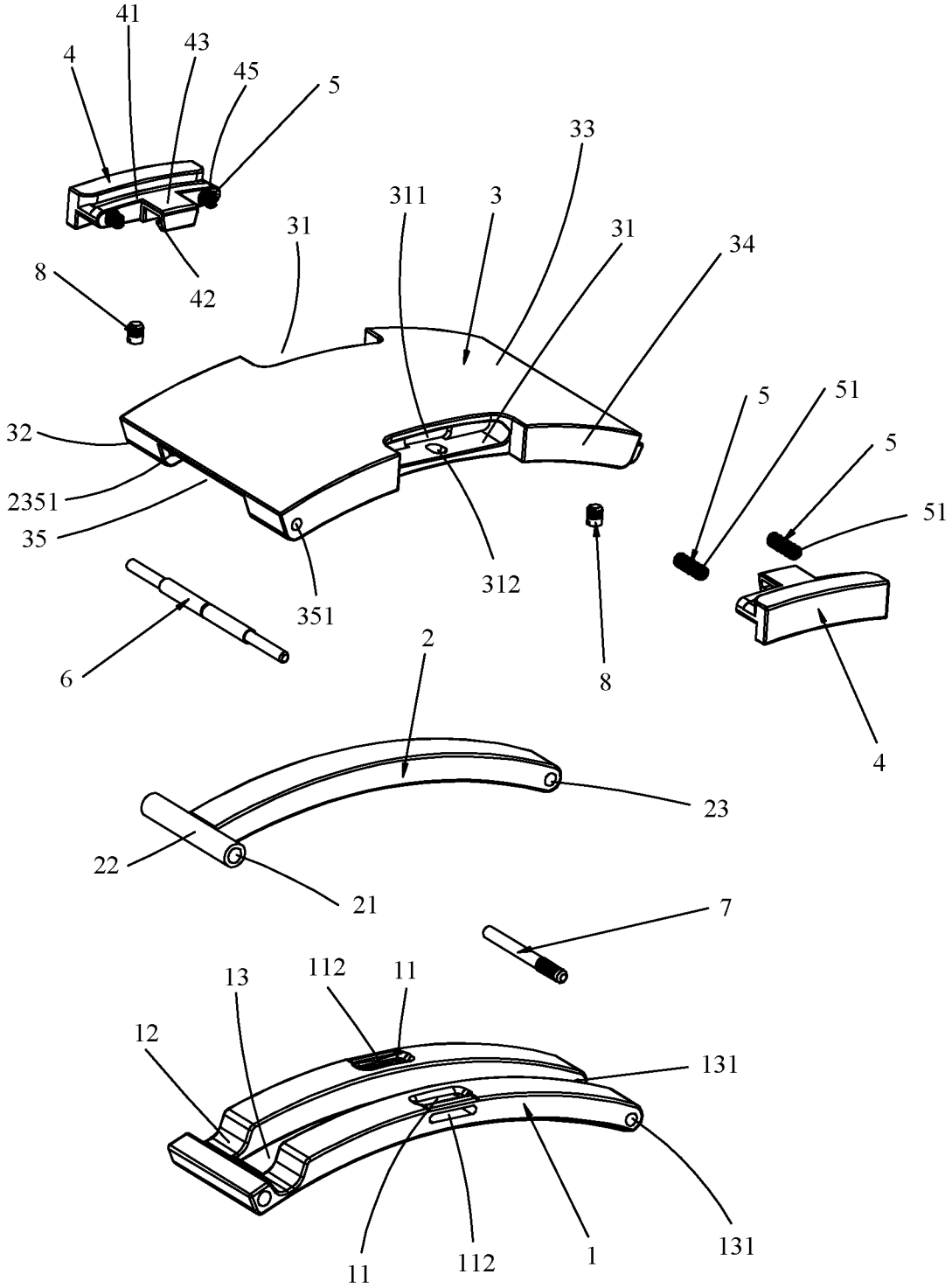
FIG. 3 is an exploded view of the watchband clasp in FIG. 2.

As shown in FIG. 2 and FIG. 3, an embodiment of this application provides a watchband clasp 1000, including a first fastener 1, a second fastener 2 rotatably mounted on the first fastener 1, a cover plate 3 rotatably mounted at an end that is of the second fastener 2 and that is away from the first fastener 1, a hook member 4 slidably mounted on the cover plate 3, and an elastic member 5 mounted between the cover plate 3 and the hook member 4. The first fastener 1 is provided with a hook hole 11 adapted to the hook member 4. The elastic member 5 can enable the hook member 4 to maintain a clamped state with an inner wall of the hook hole 11. When the watchband clasp 1000 is applied to a watch, one end of the first fastener 1 is connected to a watch chain of the watch, the other end of the first fastener 1 is connected to the second fastener 2, one end of the cover plate 3 is connected to the end that is of the second fastener 2 and that is away from the first fastener 1, and the other end of the cover plate 3 is connected to the watch chain of the watch.

Figure 4:
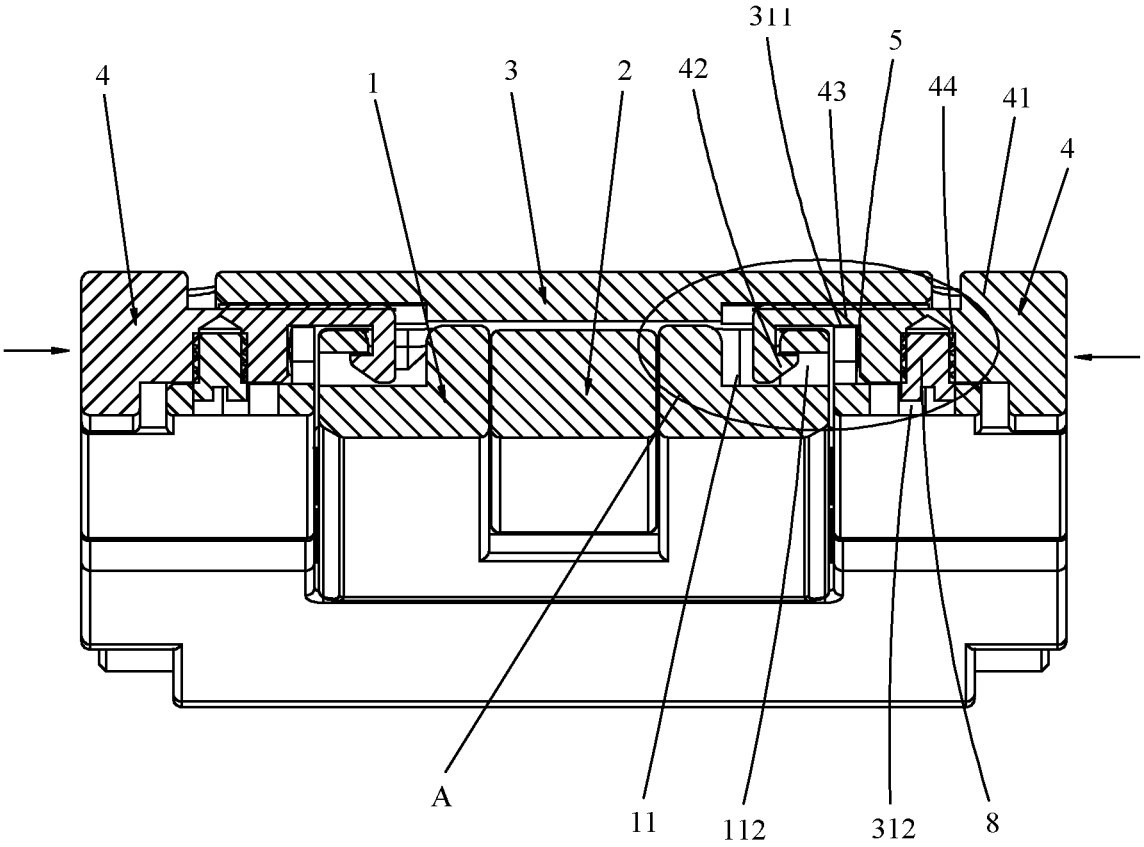
FIG. 4 is a sectional view of the watchband clasp in FIG. 2.
Figure 5:
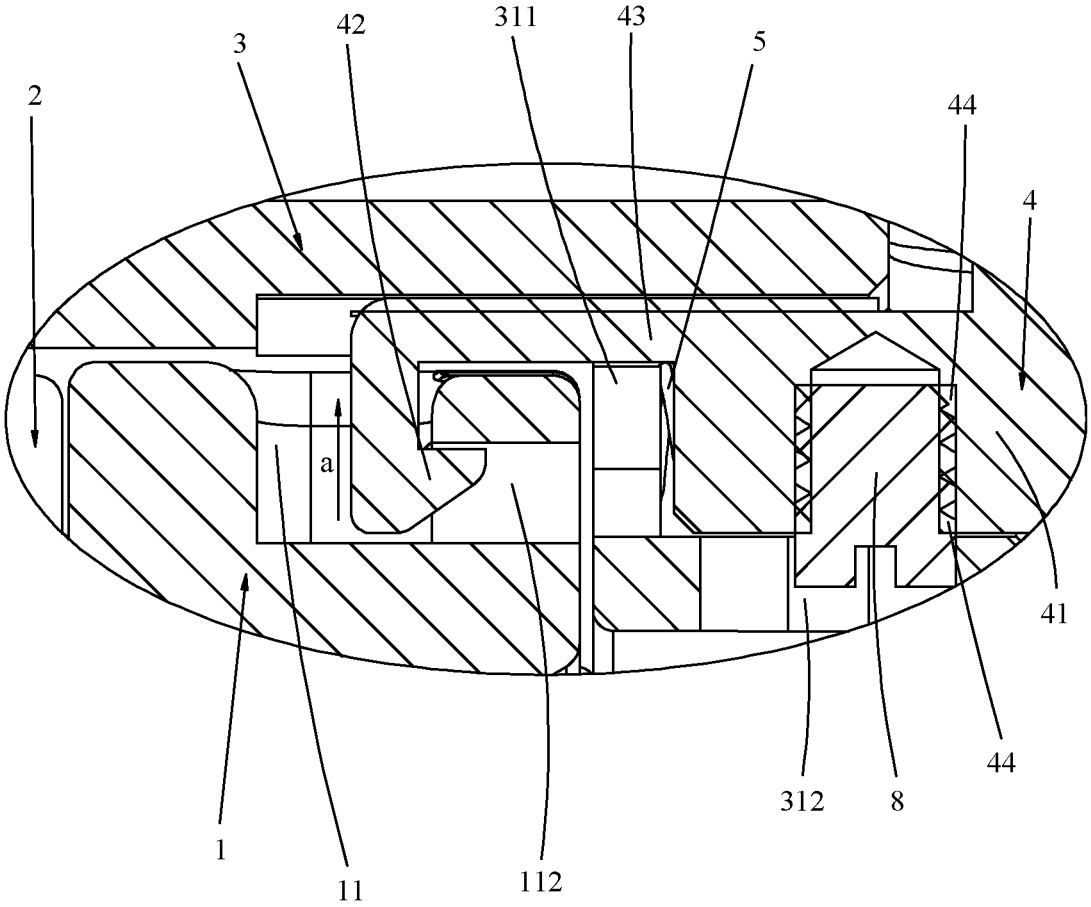
FIG. 5 is a partially enlarged view at A in FIG. 4.

Further refer to FIG. 4 and FIG. 5. In this embodiment of this application, the first fastener 1 and the cover plate 3 are separately rotatably connected to two opposite ends of the second fastener 2. When the watchband clasp 1000 is in a locked state, the first fastener 1 and the cover plate 3 each rotate a specific angle relative to the second fastener 2, so that the first fastener 1, the second fastener 2, and the cover plate 3 are stacked together. In this case, the hook member 4 slidably mounted on the cover plate 3 extends into the hook hole 11 on the first fastener 1, and is clamped to the inner wall of the hook hole 11. Therefore, neither the first fastener 1 nor the cover plate 3 can rotate relative to the second fastener 2, and the locked state of the watchband clasp 1000 is implemented. Because the elastic member 5 is disposed between the cover plate 3 and the hook member 4, the elastic member 5 may restrict sliding of the hook member 4 relative to the cover plate 3, so that the hook member 4 remains clamped to the inner wall of the hook hole 11.

The cover plate 3 is provided with a first accommodation slot 35 that is used to accommodate the first fastener 1 and the second fastener 2. When the watchband clasp 1000 is in the locked state, and the first fastener 1, the second fastener 2, and the cover plate 3 are stacked together, the first fastener 1 and the second fastener 2 may be completely located in the first accommodation slot 35 of the cover plate 3, and most of the first fastener 1 and most of the second fastener 2 are located in the first accommodation slot 35, so that compactness of a structure of the watchband clasp 1000 is further implemented. In addition, surfaces of the second fastener 2 and the cover plate 3 may be approximately flush. This can further improve comfort of contact between the watchband clasp 1000 and skin at the wrist.

On the premise that the first fastener 1 and the second fastener 2 are located inside the cover plate 3, the hook member 4 slidably mounted on the cover plate 3 extends into the hook hole 11 on the first fastener 1 through a surface on a side that is of the first fastener 1 and that faces the cover plate 3, and is clamped to the inner wall of the hook hole 11, so that the cover plate 3 and the first fastener 1 are fastened to each other. In this case, refer to FIG. 6, the hook member 4 does not protrude from a surface on a side that is of the first fastener 1 and that is away from the cover plate 3, that is, the first fastener 1 that is in contact with the skin at the wrist has no protrusion structure. Wearing comfort is not likely to be affected by a protrusion structure against the skin at the wrist.

Refer to FIG. 2 to FIG. 5. When the locked state of the watchband clasp 1000 needs to be released, a finger may exert a force on the hook member 4 and overcome a reaction force exerted by the elastic member 5, to drive the hook member 4 to slide relative to the cover plate 3, and release a clamped state between the hook member 4 and the inner wall of the hook hole 11. This operation manner is relatively convenient. For a state in which the watchband clasp 1000 is unfastened, refer to FIG. 9 and FIG. 10.

It may be understood that, when the first fastener 1, the second fastener 2, and the cover plate 3 are stacked together, and the second fastener 2 is located between the first fastener 1 and the cover plate 3, a principle in which the hook member 4 that is slidably mounted on the cover plate 3 cooperates with the hook hole 11 on the first fastener 1 includes the following manners. In one manner, refer to FIG. 5, a width of the second fastener 2 is set to be less than a width of the first fastener 1, and the hook member 4 is disposed outside a boundary range corresponding to the second fastener 2. Therefore, the second fastener 2 does not block the hook member 4, and the hook member 4 can extend into the hook hole 11 on the first fastener 1. In another manner, a through hole corresponding to the hook member 4 is disposed on the second fastener 2, and the hook member 4 penetrates through the through hole on the second fastener 2 and extends into the hook hole 11 on the first fastener 1.

Refer to FIG. 4 and FIG. 5. The hook member 4 includes a sliding plate 41 slidably mounted on the cover plate 3 and a first hook 42 that is connected to the sliding plate 41. The hook hole 11 is provided with a limiting part movably connected to the first hook 42 (for example, in FIG. 4 and FIG. 5, the limiting part is a clamping hole 112). The limiting part can restrain the first hook 42 from leaving the hook hole 11 in a depth direction a of the hook hole 11. Only after the finger presses the hook member 4 and overcomes a reaction force exerted by the elastic member 5, to enable the hook member 4 to slide relative to the cover plate 3, and release the connection between the first hook 42 and the limiting part, the first hook 42 can leave the hook hole 11 in the depth direction a of the hook hole 11.

Refer to FIG. 4 and FIG. 5. In this embodiment of this application, the limiting part is the clamping hole 112. A manner of clamping the hook member 4 to the inner wall of the hook hole 11 may be as follows: The first hook 42 of the hook member 4 extends into the hook hole 11, and under the action of the elastic member 5, the sliding plate 41 slides and drives the first hook 42 to be inserted into the clamping hole 112 on the inner wall of the hook hole 11. In this case, the first hook 42 abuts against an inner wall of the clamping hole 112 and cannot move relative to the first fastener 1 in an axial direction of the hook hole 11, and this limits rotation of the cover plate 3 relative to the first fastener 1, so that the watchband clasp 1000 remains in the locked state.

Refer to FIG. 3 to FIG. 5. The hook hole 11 is disposed on a surface that is of the first fastener 1 and that faces the cover plate 3, and the depth direction a of the hook hole 11 is disposed in a thickness direction of the first fastener 1 (a direction perpendicular to the cover plate 3). The clamping hole 112 is disposed on an inner side wall of the hook hole 11, and is connected to the hook hole 11. A depth direction of the clamping hole 112 is perpendicular to the depth direction a of the hook hole 11. Therefore, for the hook member 4 in the hook hole 11, after the first hook 42 of the hook member 4 is inserted into the clamping hole 112 on the inner wall of the hook hole 11 under the action of the elastic member 5, the first hook 42 of the hook member 4 cannot leave the hook hole 11 in the depth direction a of the hook hole 11. When the first hook 42 of the hook member 4 is located in the hook hole 11, but the first hook 42 is not inserted into the clamping hole 112 on the inner wall of the hook hole 11, the first hook 42 may freely leave the hook hole 11 in the depth direction a of the hook hole 11.

Refer to FIG. 3. In another specific implementation of the watchband clasp 1000 provided in this application, the cover plate 3 is provided with a sliding slot 31, and the hook member 4 is slidably mounted in the sliding slot 31 on the cover plate 3, so that most of the hook member 4 is located in the cover plate 3, to implement miniaturization of the watchband clasp 1000. In addition, an inner wall of the sliding slot 31 may limit a plurality of places on the hook member 4, to cooperate with the elastic member 5 to slidably mount the hook member 4 on the cover plate 3 stably. When an external force drives the hook member 4 to slide, the hook member 4 is not prone to detach from the cover plate 3.

Refer to FIG. 4 and FIG. 5. The hook member 4 further includes a connection plate 43 connected between the first hook 42 and the sliding plate 41 (for example, the sliding plate 41, the first hook 42, and the connection plate 43 may be an integral part). When the hook member 4 slides, the sliding plate 41 serving as a main body of sliding slides relative to the cover plate 3, and drives the connection plate 43 and the first hook 42 to move. An included angle between the first hook 42 and the connection plate 43 ranges from 85 degrees to 95 degrees (the included angle may be 90 degrees or approximately 90 degrees). Therefore, when the first hook 42 extends into the hook hole 11, the connection plate 43 may be located outside the hook hole 11. Therefore, when an external force drives the hook member 4 to move in a direction perpendicular to the axial direction of the hook hole 11, the clamped state between the first hook 42 and the inner wall of the hook hole 11 can be released, so that the cover plate 3 may rotate relative to the first fastener 1, to release the locked state of the watchband clasp 1000. For example, the first hook 42 is driven to leave the clamping hole 112 on the inner wall of the hook hole 11, so that the clamped state between the first hook 42 and the inner wall of the clamping hole 112 is released.

Refer to FIG. 4 and FIG. 5. The inner wall of the sliding slot 31 is provided with a spacing hole 311, and the connection plate 43 penetrates through the spacing hole 311. Therefore, the spacing hole 311 may be used as a guide structure in which the connection plate 43 slides with the sliding plate 41, so that the connection plate 43 can move in only an axial direction of the spacing hole 311. When the hook member 4 is pressed by an external force, even if the applied force is not completely parallel to the axial direction of the spacing hole 311, the connection plate 43 may still be limited by the spacing hole 311, so that the hook member 4 integrally slides in the axial direction of the spacing hole 311.

Refer to FIG. 2 and FIG. 3. In another specific implementation of the watchband clasp 1000 provided in this application, when the watchband clasp 1000 is in the locked state, and the first fastener 1, the second fastener 2, and the cover plate 3 are stacked together, the cover plate 3 has a front face 32 facing the second fastener 2, a rear face 33 facing back to the second fastener 2, and a side face 34 connected between the front face 32 and the rear face 33. The sliding slot 31 may be disposed on the rear face 33 of the cover plate 3.

As shown in FIG. 3, when the sliding slot 31 is disposed on the rear face 33 of the cover plate 3, that is, when the hook member 4 is slidably mounted in the sliding slot 31 on the rear face 33, even if the hook member 4 does not protrude from the rear face 33, a user can still exert a force on the hook member 4, to drive the hook member 4 to slide relative to the cover plate 3. In this case, the watchband clasp 1000 has no protrusion structure in a position in contact with the skin, and almost has no protrusion structure in a position away from the skin, so that compactness of the structure of the watchband clasp 1000 is implemented.

Refer to FIG. 3 to FIG. 5. In another specific implementation of the watchband clasp 1000 provided in this application, the front face 32 of the cover plate 3 is provided with a first accommodation slot 35 used to accommodate the first fastener 1 and the second fastener 2, and a spacing hole 311 is connected to the first accommodation slot 35. When the watchband clasp 1000 is in the locked state, and the first fastener 1, the second fastener 2, and the cover plate 3 are stacked together, the second fastener 2 may be completely located in the first accommodation slot 35 of the cover plate 3, and most of the second fastener 2 is located in the first accommodation slot 35. This further implements compactness of the structure of the watchband clasp 1000. In addition, surfaces of the second fastener 2 and the cover plate 3 may be approximately flush. This can further improve comfort of contact between the watchband clasp 1000 and the skin at the wrist.

Figure 8:
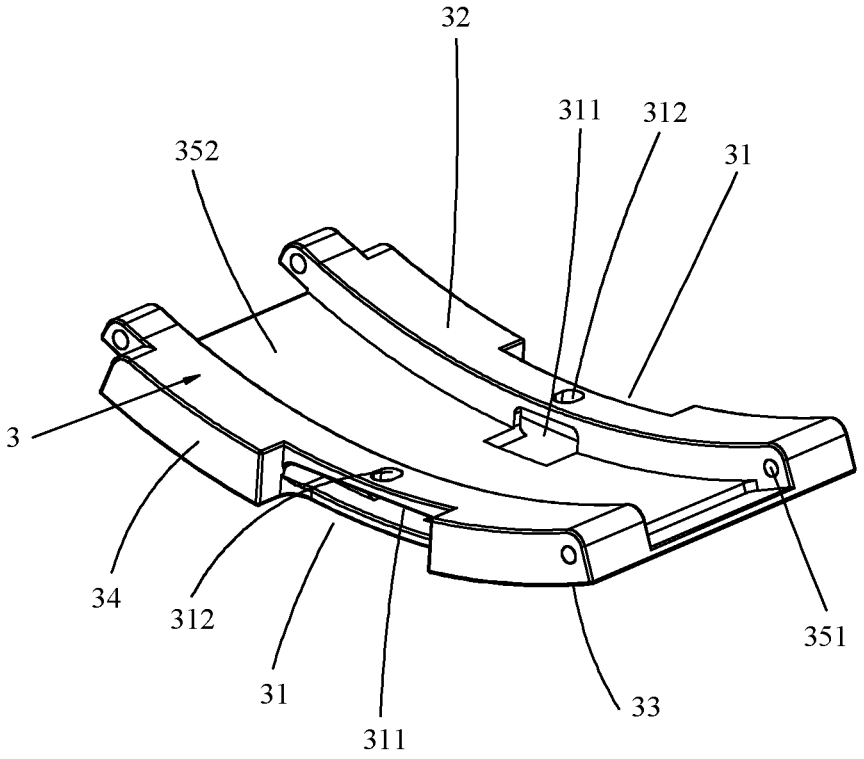
FIG. 8 is a schematic diagram of a structure of a cover plate of the watchband clasp in FIG. 2.
Figure 9:
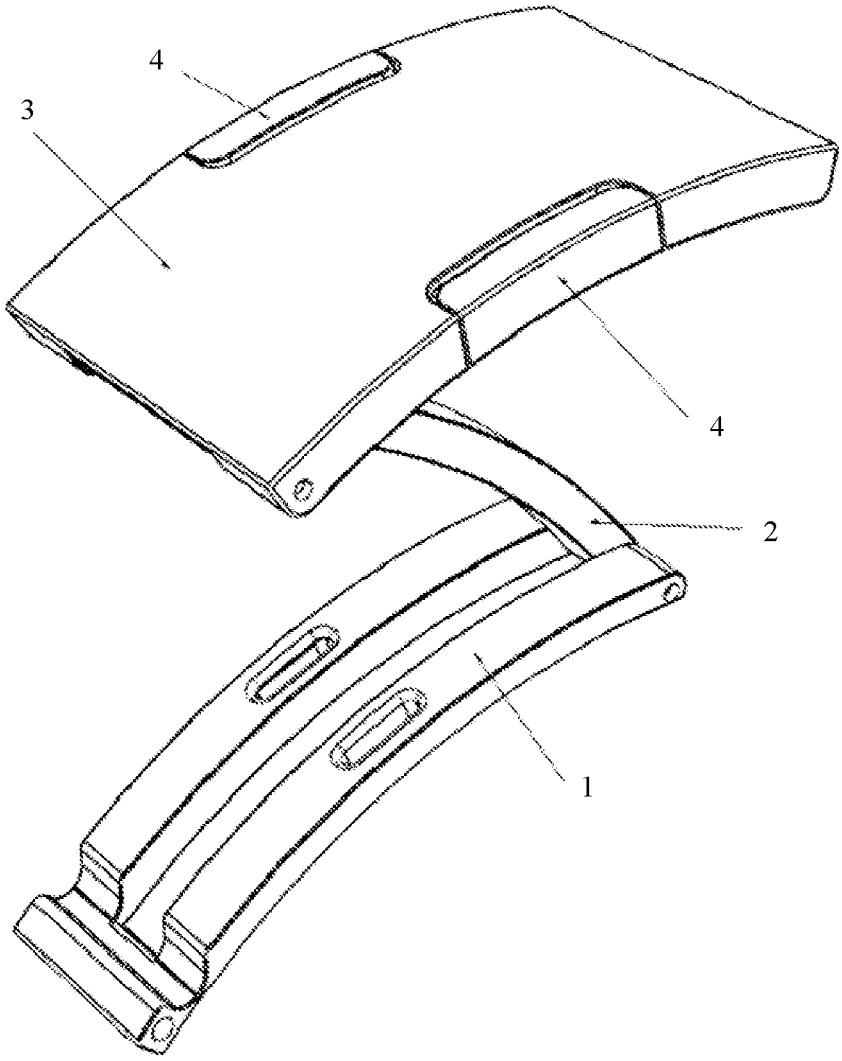
FIG. 9 is a schematic diagram of a structure at a viewing angle of the watchband clasp in FIG. 2 after the watchband clasp is released from a locked state (when the watchband clasp is released)
Figure 10:
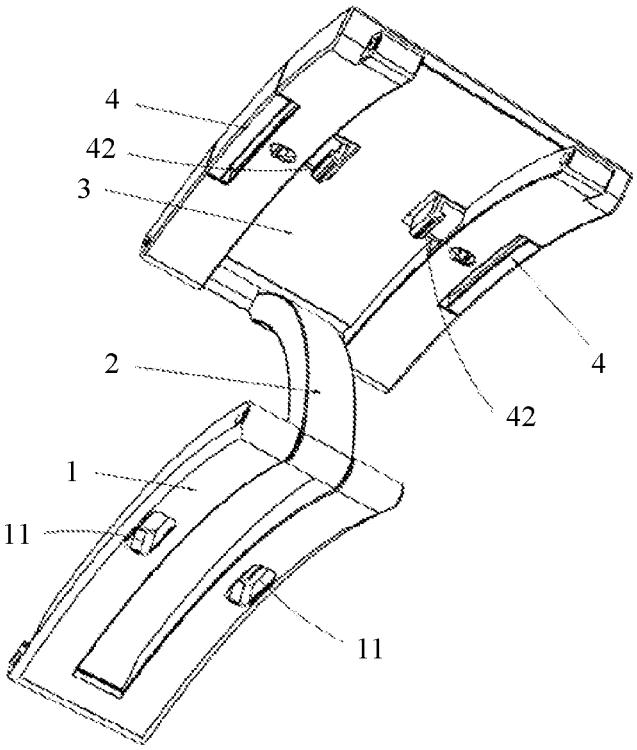
FIG. 10 is a schematic diagram of a structure at another viewing angle of the watchband clasp in FIG. 2 after the watchband clasp is released from a locked state (when the watchband clasp is released)

As shown in FIG. 8, the spacing hole 311 is connected to the first accommodation slot 35. Therefore, the connection plate 43 of the hook member 4 can extend into the first accommodation slot 35, that is, movement of the first hook 42 driven by the connection plate 43 also occurs in the first accommodation slot 35, so that a state in which the first hook 42 slides is hidden inside the watchband clasp 1000.

Refer to FIG. 3. In another specific implementation of the watchband clasp 1000 provided in this application, first rotation holes 351 are disposed on two opposite inner walls of the first accommodation slot 35. The second fastener 2 is provided with a second rotation hole 21. A first rotating connection shaft 6 is disposed between the second fastener 2 and the cover plate 3, the first rotating connection shaft 6 penetrates through the second rotation hole 21, and two opposite ends of the first rotating connection shaft 6 are separately rotatably mounted in the two first rotation holes 351.

Because the two first rotation holes 351 are separately disposed on the two opposite inner walls of the first accommodation slot 35, the second fastener 2 is rotatably mounted on the inner wall of the first accommodation slot 35 on the cover plate 3 through the first rotating connection shaft 6. After rotating relative to the cover plate 3, the second fastener 2 may integrally rotate into the first accommodation slot 35, and may be hidden in the cover plate 3, to implement compactness of the structure of the watchband clasp 1000.

Refer to FIG. 3. In another specific implementation of the watchband clasp 1000 provided in this application, the second fastener 2 has a rotation cylinder 22. The rotation cylinder 22 is provided with the second rotation hole 21. The first fastener 1 is provided with a second accommodation slot 12 that is adapted to the rotation cylinder 22.

The first accommodation slot 35 of the cover plate 3 may be used to accommodate the first fastener 1 and the second fastener 2. In some embodiments, a width of the second fastener 2 is less than that of the first fastener 1, and the rotation cylinder 22 may be disposed on the second fastener 2 to implement a rotatable connection between the second fastener 2 and the cover plate 3. A length (a length in an axial direction) of the rotation cylinder 22 is greater than the width of the second fastener 2, but slightly less than a width (a width in the axial direction of the rotation cylinder 22) of the first accommodation slot 35. Therefore, the inner wall that is of the first accommodation slot 35 and that is provided with the first rotation hole 351 may indirectly limit the second fastener 2 by limiting two opposite ends of the rotation cylinder 22, so that the second fastener 2 can move relative to the cover plate 3 mainly through only rotation of the first rotating connection shaft 6.

Optionally, as shown in FIG. 3, the first fastener 1 is provided with the second accommodation slot 12 that is used to accommodate a part that is of the rotation cylinder 22 and that protrudes from the surface of the second fastener 2. In this way, after the first fastener 1 rotates a specific angle relative to the second fastener 2, existence of the rotation cylinder 22 does not cause a large gap between the first fastener 1 and the second fastener 2.

Refer to FIG. 3. In another specific implementation of the watchband clasp 1000 provided in this application, the first fastener 1 is provided with an accommodation hole 13 that is used to accommodate the second fastener 2, and a depth of the accommodation hole 13 is greater than or equal to a thickness of the second fastener 2. After the second fastener 2 rotates relative to the first fastener 1, the second fastener 2 may approximately be integrally located in the accommodation hole 13. When the first fastener 1, the second fastener 2, and the cover plate 3 are stacked together, a depth of the first accommodation slot 35 on the cover plate 3 needs only to match a thickness of the first fastener 1. This reduces a thickness of the watchband clasp 1000 in the locked state.

Refer to FIG. 3. In another specific implementation of the watchband clasp 1000 provided in this application, third rotation holes 131 are disposed on two opposite inner walls of the accommodation hole 13, a fourth rotation hole 23 is disposed on the second fastener 2, and a second rotating connection shaft 7 is disposed between the first fastener 1 and the second fastener 2.

The second rotating connection shaft 7 penetrates through the fourth rotation hole 23 on the second fastener 2, and two opposite ends of the second rotating connection shaft 7 are separately rotatably mounted in the two third rotation holes 131. Because the two third rotation holes 131 are separately disposed on the two opposite inner walls of the accommodation hole 13, the second fastener 2 is rotatably mounted on the inner wall of the accommodation hole 13 of the first fastener 1 through the second rotating connection shaft 7. After rotating relative to the first fastener 1, the second fastener 2 may integrally rotate into the accommodation hole 13, and may be hidden in the first fastener 1, to implement compactness of the structure of the watchband clasp 1000. In addition, because the second fastener 2 is integrally hidden in the first fastener 1, when the first fastener 1, the second fastener 2, and the cover plate 3 are stacked together, a depth of the first accommodation slot 35 on the cover plate 3 needs only to match a thickness of the first fastener 1. This reduces a thickness of the watchband clasp 1000 in the locked state.

Refer to FIG. 3. The inner wall of the sliding slot 31 is provided with a limiting waist-type hole 312, and a limiting connector (for example, a limiting screw 8) is disposed between the hook member 4 and the cover plate 3. The limiting connector penetrates through the limiting waist-type hole 312, and is fixedly connected to the hook member 4. A length and a width of the limiting waist-type hole 312 are both set to be greater than an outer diameter of the limiting connector. Therefore, the hook member 4 may drive the limiting connector to move, and two opposite inner walls in a length direction of the limiting waist-type hole 312 may be against the limiting connector. That is, a sliding stroke of the hook member 4 relative to the cover plate 3 is determined by the length of the limiting waist-type hole 312. Therefore, when the hook member 4 is driven to slide by an external force, the hook member 4 is not likely to be taken away from the cover plate 3 in a direction perpendicular to an axis of the limiting waist-type hole 312, and it is not prone to produce strong impact between the hook member 4 and the inner wall of the hook hole 11 in the direction perpendicular to the axis of the limiting waist-type hole 312.

Figure 6:
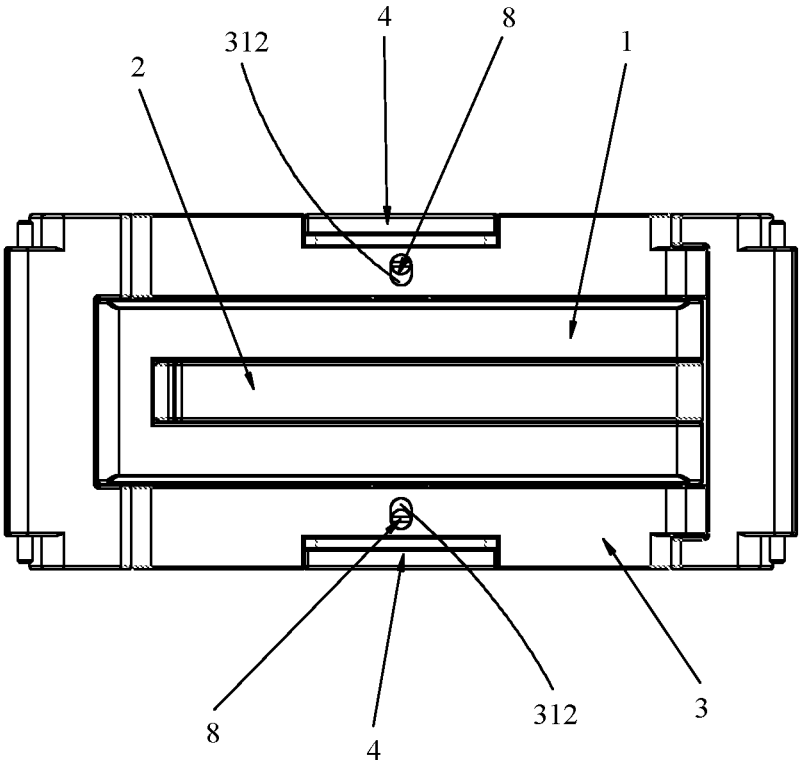
FIG. 6 is a bottom view of the watchband clasp in FIG. 2.
Figure 7:
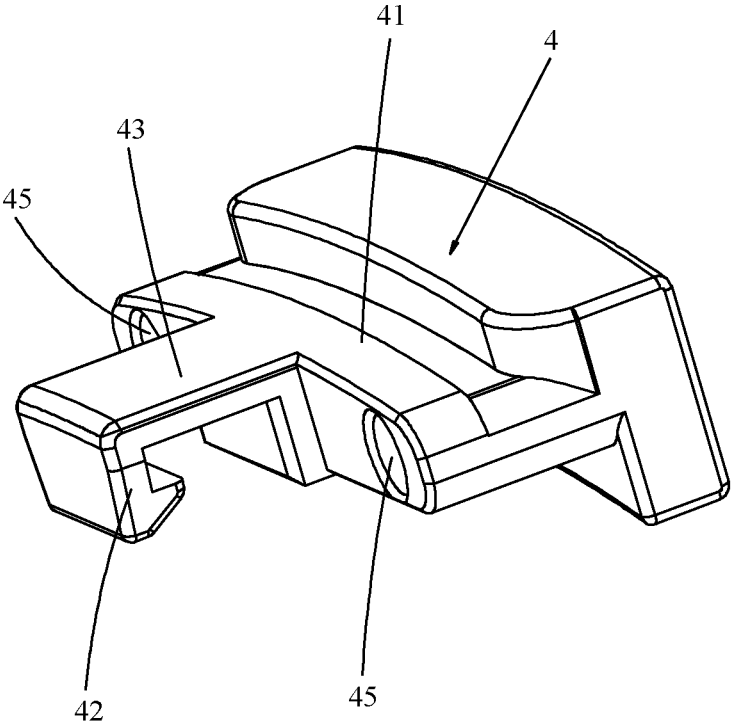
FIG. 7 is a schematic diagram of a structure of a hook member of the watchband clasp in FIG. 2.

When the limiting connector is the limiting screw 8, a threaded hole 44 is disposed on the hook member 4, and the limiting screw 8 penetrates through the limiting waist-type hole 312 and is threadedly connected to the threaded hole 44. As shown in FIG. 6, both the length (a length of two longer ends) and the width (a width of two shorter ends) of the limiting waist-type hole 312 are greater than an outer diameter of the limiting screw 8. As shown in FIG. 3, an included angle between the axis of the limiting waist-type hole 312 and the axis of the spacing hole 311 may range from 85 degrees to 95 degrees.

The connecting screw penetrates through the limiting waist-type hole 312 on the inner wall of the sliding slot 31, and is threadedly connected to the threaded hole 44 on the hook member 4. The length and the width of the limiting waist-type hole 312 are both set to be greater than the outer diameter of the limiting screw 8. Therefore, the hook member 4 may drive the limiting screw 8 to move, and the two opposite inner walls in the length direction of the limiting waist-type hole 312 may be against the limiting screw 8. That is, a sliding stroke of the hook member 4 relative to the cover plate 3 is determined by the length of the limiting waist-type hole 312. Therefore, when the hook member 4 is driven to slide by an external force, the hook member 4 is not likely to be taken away from the cover plate 3 in a direction perpendicular to an axis of the limiting waist-type hole 312, and it is not prone to produce strong impact between the hook member 4 and the inner wall of the hook hole 11 in the direction perpendicular to the axis of the limiting waist-type hole 312.

The limiting screw 8 located in the limiting waist-type hole 312 may perform a specific limit on the hook member 4 in the direction perpendicular to the axis of the limiting waist-type hole 312, and the inner wall of the spacing hole 311 may limit the hook member 4 in a direction perpendicular to the axis of the spacing hole 311. The included angle between the axis of the limiting waist-type hole 312 and the axis of spacing hole 311 ranges from 85 degrees to 95 degrees (for example, is 90 degrees or approximately 90 degrees). Therefore, the limiting screw 8 and the spacing hole 311 may separately perform a specific limit on the hook member 4 in different directions, so that the hook member 4 is slidably mounted on the cover plate 3 stably, and is not prone to detach from the cover plate 3. In particular, when the axis of the limiting waist-type hole 312 and the axis of the spacing hole 311 are perpendicular to each other, the limiting screw 8 may exert a specific limit on the hook member 4 on the horizontal plane, and the inner wall of the spacing hole 311 may limit the hook member 4 on the vertical plane, so that the hook member 4 is not prone to detach from the cover plate 3, and may be slidably mounted on the cover plate 3 stably.

In another embodiment of this application, the limiting connector may alternatively be another component, provided that the limiting connector can penetrate through the limiting waist-type hole 312 and be fixedly connected to the hook member 4.

Refer to FIG. 3. In another specific implementation of the watchband clasp 1000 provided in this application, the elastic member 5 is a spring 51. The spring 51 is in a natural state, and may restrict sliding of the hook member 4 relative to the cover plate 3, so that the hook member 4 remains clamped to the inner wall of the hook hole. In this case, the hook member 4 cannot move relative to the first fastener 1 in an axial direction of the hook hole 11, and this restricts rotation of the cover plate 3 relative to the first fastener 1, so that the watchband clasp 1000 remains in the locked state.

When the locked state of the watchband clasp 1000 needs to be released, a finger may exert a force on the hook member 4 and overcome a reaction force exerted by the spring 51, to drive the hook member 4 to slide relative to the cover plate 3, and release the clamped state between the hook member 4 and the inner wall of the hook hole 11.

For example, when the spring 51 is a compression spring, in a process of pressing the hook member 4 to compress the compression spring, the hook member 4 may be driven to slide relative to the cover plate 3, and the clamped state between the hook member 4 and the inner wall of the hook hole 11 may be released.

For example, when the spring 51 is a tension spring, in a process of pulling (plucking) the hook member 4 to stretch the tension spring, the hook member 4 may be driven to slide relative to the cover plate 3, and the clamped state between the hook member 4 and the inner wall of the hook hole 11 may be released.

For example, an axis of the spring 51 may be parallel to the axis of the spacing hole 311. A force exerted by the spring 51 on the connection plate 43 (the hook member 4) is in the axial direction of the spacing hole 311, so that the force exerted by the spring 51 on the hook member 4 is mostly used to tightly clamp the hook member 4 to the inner wall of the hook hole 11, to ensure that the watchband clasp 1000 in the locked state is relatively stable.

Refer to FIG. 3. In another specific implementation of the watchband clasp 1000 provided in this application, a mounting slot 45 is disposed on the hook member 4, one end of the spring 51 is against the bottom of the mounting slot 45, and the other end of the spring 51 is against the cover plate 3. An end of the spring 51 is mounted in the mounting slot 45, to hide most of the spring 51 inside the hook member 4, and implement compactness of the structure of the watchband clasp 1000. A radial direction of the spring 51 may further be limited, so that the spring 51 deforms almost in only an axial direction.

Refer to FIG. 4 and FIG. 5. In another specific implementation of the watchband clasp 1000 provided in this application, an included angle between the axis of the spring 51 and the axis of the hook hole 11 ranges from 85 degrees to 95 degrees (for example, is 90 degrees or approximately 90 degrees). Therefore, a force exerted by the spring 51 on the hook member 4 is not parallel to the axis of the hook hole 11, and the force exerted by the spring 51 on the hook member 4 necessarily has a component force in a direction perpendicular to the axis of the hook hole 11, so that the hook member 4 can be stably clamped to the inner wall of the hook hole 11. For example, the first hook 42 of the hook member 4 may extend into the clamping hole 112 on the inner wall of the hook hole 11, and be against the inner wall of the clamping hole 112, to ensure a good clamped state, and implement stability of the watchband clasp 1000 in the locked state.

Refer to FIG. 4. In another specific implementation of the watchband clasp 1000 provided in this application, there are two hook members 4, and the two hook members 4 are disposed oppositely and spaced from each other. The two hook members 4 are slidably mounted on the cover plate 3 in an opposite and spaced manner. When the locked state of the watchband clasp 1000 needs to be released, the thumb and the index finger of the hand each may press one hook member 4, and then the thumb and the index finger exert forces in opposite directions, to drive the two hook members 4 to move toward each other, and overcome the reaction force exerted by the elastic member 5, so that the elastic member 5 deforms, to release the clamped state between the hook member 4 and the inner wall of the hook hole 11.

The thumb and the index finger of the hand each may drive one hook member 4 to move. Therefore, both the thumb and the index finger may move toward the center of the cover plate 3, and pressure exerted by the two hook members 4 on the cover plate 3 through the elastic member 5 is relatively symmetrical. The cover plate 3 is not prone to deflect and can be operated with one hand.

The two hook members 4 are slidably mounted on the cover plate 3 in an opposite and spaced manner. Therefore, the two hook members 4 may be separately clamped to inner walls of two hook holes 11 on the first fastener 1. When the watchband clasp 1000 is in the locked state, the cover plate 3 and the first fastener 1 are connected through two symmetrically disposed hook members 4. When no force is exerted to drive the hook member 4 to slide, the cover plate 3 is not prone to move relative to the second fastener 2, and the watchband clasp 1000 is in a relatively stable locked state.

With reference to FIG. 11 to FIG. 17, the following describes Embodiment 2 of a watchband clasp 1000 according to this application.

Figure 11:
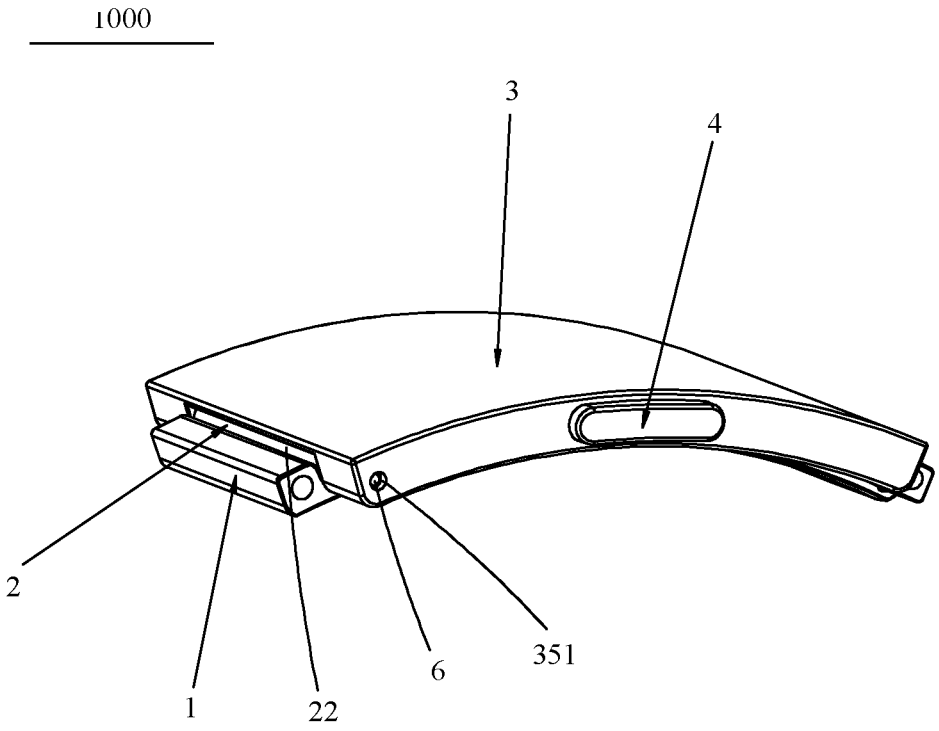
FIG. 11 is a schematic diagram of a structure of a watchband clasp in a locked state according to Embodiment 2 of this application.
Figure 12:
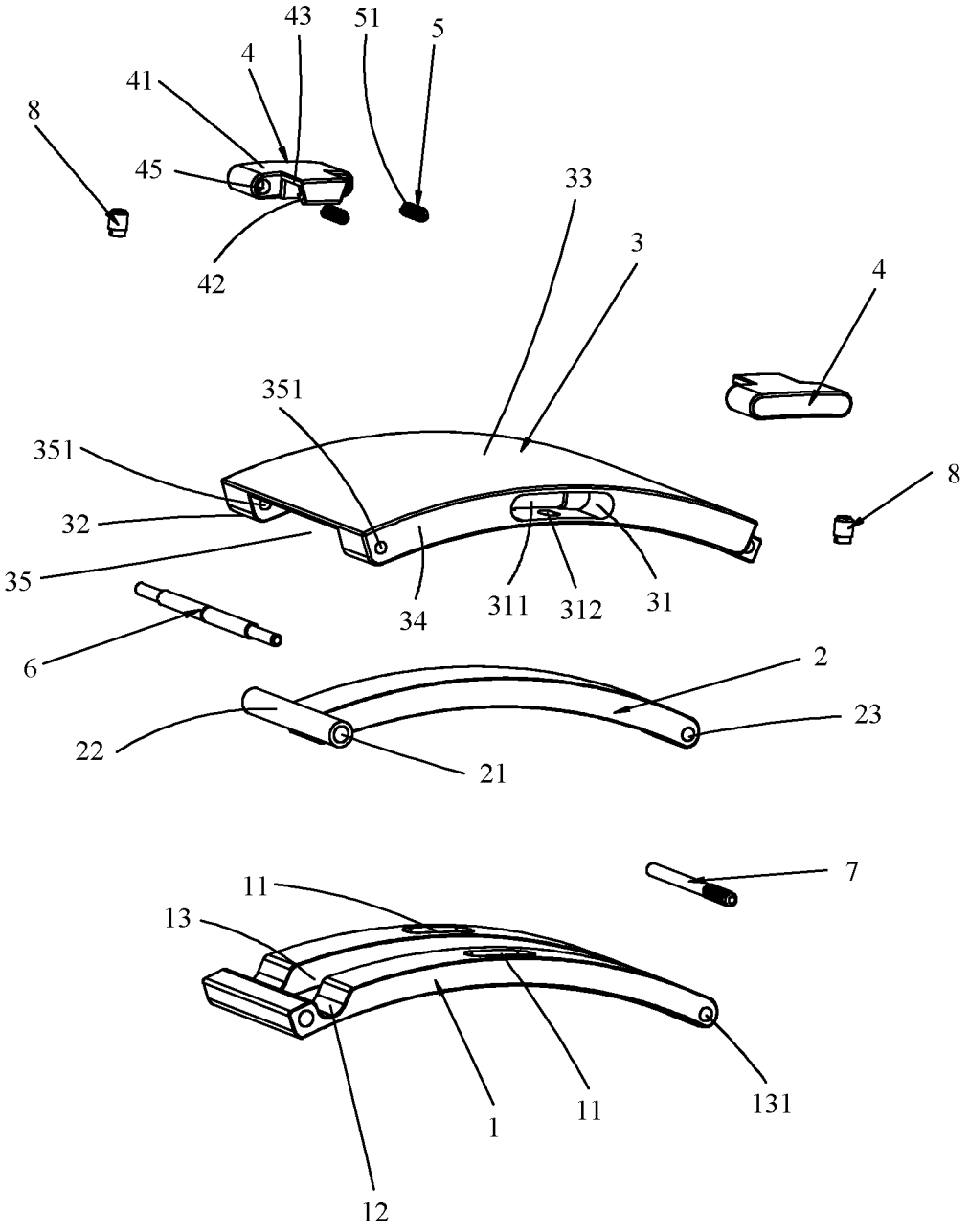
FIG. 12 is an exploded view of the watchband clasp in FIG. 11.

Refer to FIG. 11 and FIG. 12. When the watchband clasp 1000 is in a locked state, and a first fastener 1, a second fastener 2, and a cover plate 3 are stacked together, the cover plate 3 has a front face 32 facing the second fastener 2, a rear face 33 facing back to the second fastener 2, and a side face 34 connected between the front face 32 and the rear face 33. A sliding slot 31 may be disposed on the side face 34 of the cover plate 3.

As shown in FIG. 12, when the sliding slot 31 is disposed on the side face 34 of the cover plate 3, that is, when a hook member 4 is slidably mounted in the sliding slot 31 on the side face 34, the hook member 4 may slightly protrude from the side face 34, so that an external force can be exerted by a finger. In this case, the rear face 33 of the cover plate 3 is in a complete state, and has good aesthetics. In addition, a corresponding pattern may be disposed on the rear face 33 of the cover plate 3, to further improve the aesthetics and achieve a good design effect.

As shown in FIG. 11 to FIG. 14, when the sliding slot 31 is disposed on the side face 34 of the cover plate 3, that is, the hook member 4 is disposed on the side face 34 of the cover plate 3, and two hook members 4 that are disposed oppositely and spaced from each other are pressed, forces exerted by the two hook members 4 on the cover plate 3 through an elastic member 5 may approximately offset each other, and the cover plate 3 is not deflected.

Figure 13:
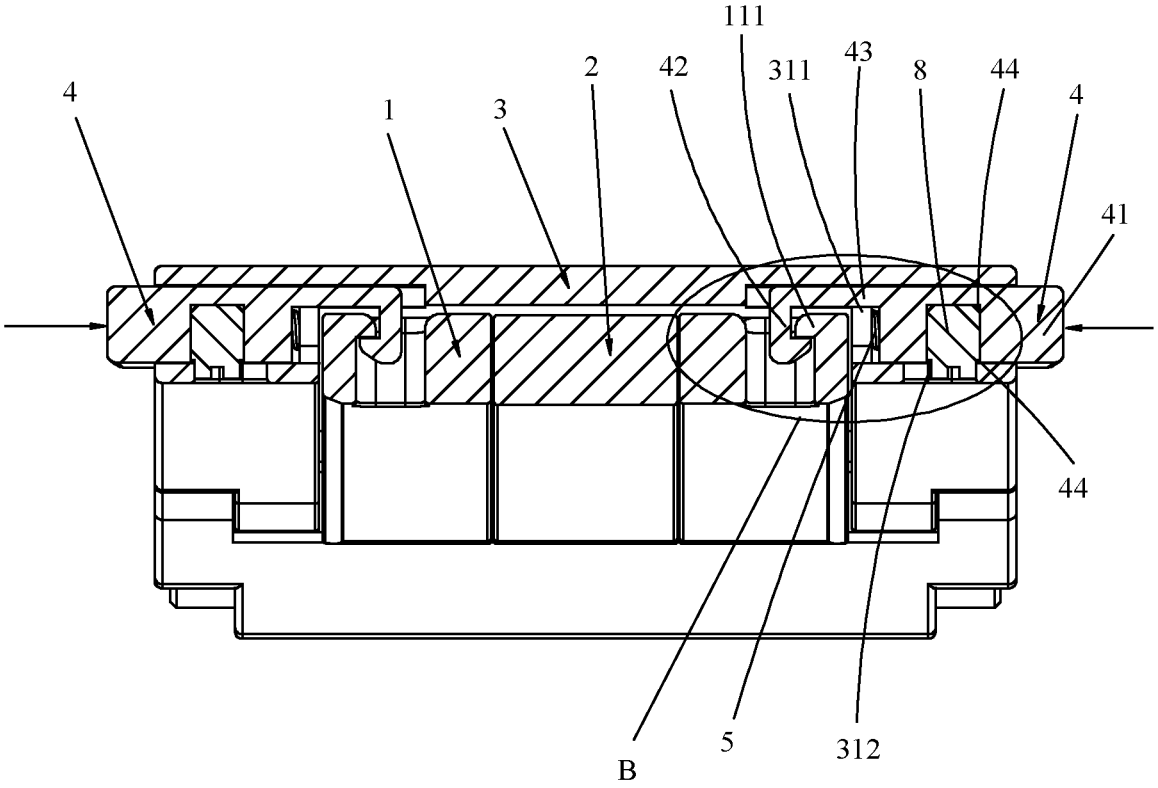
FIG. 13 is a sectional view of the watchband clasp in FIG. 11.
Figure 14:
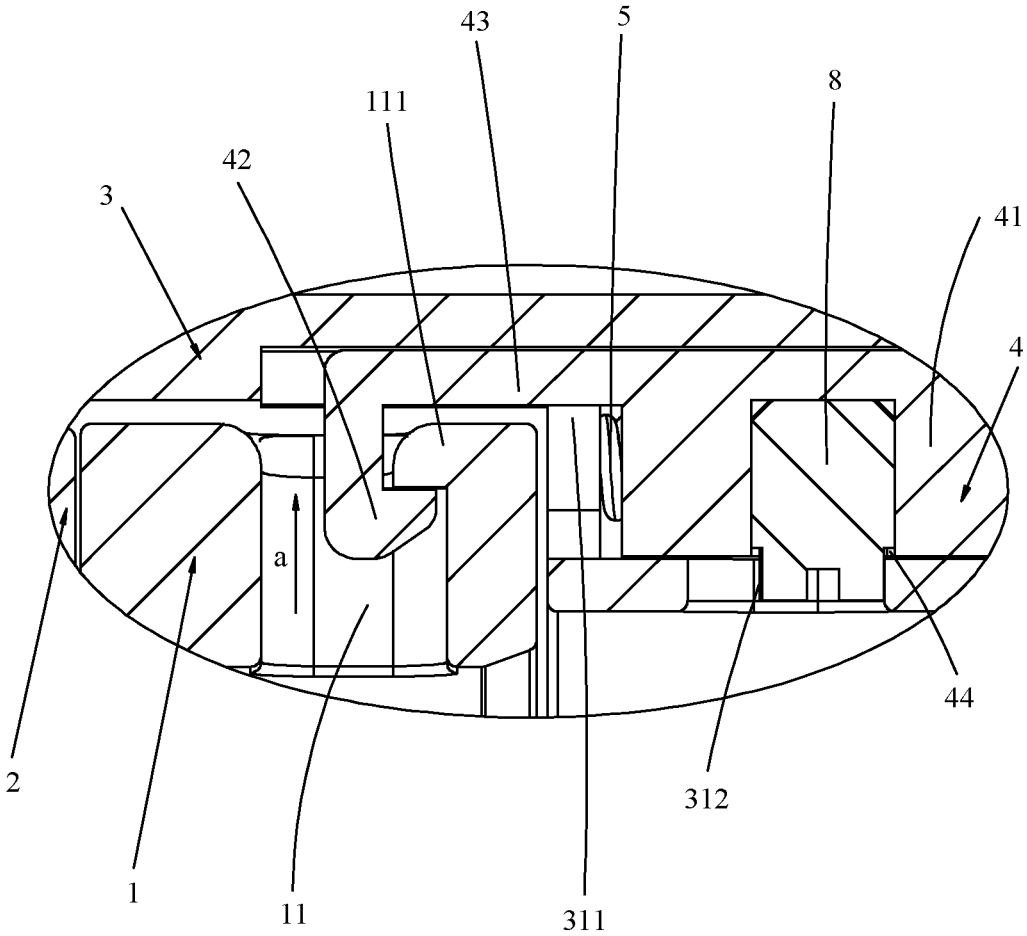
FIG. 14 is a partially enlarged view at B in FIG. 13.
Figure 15:
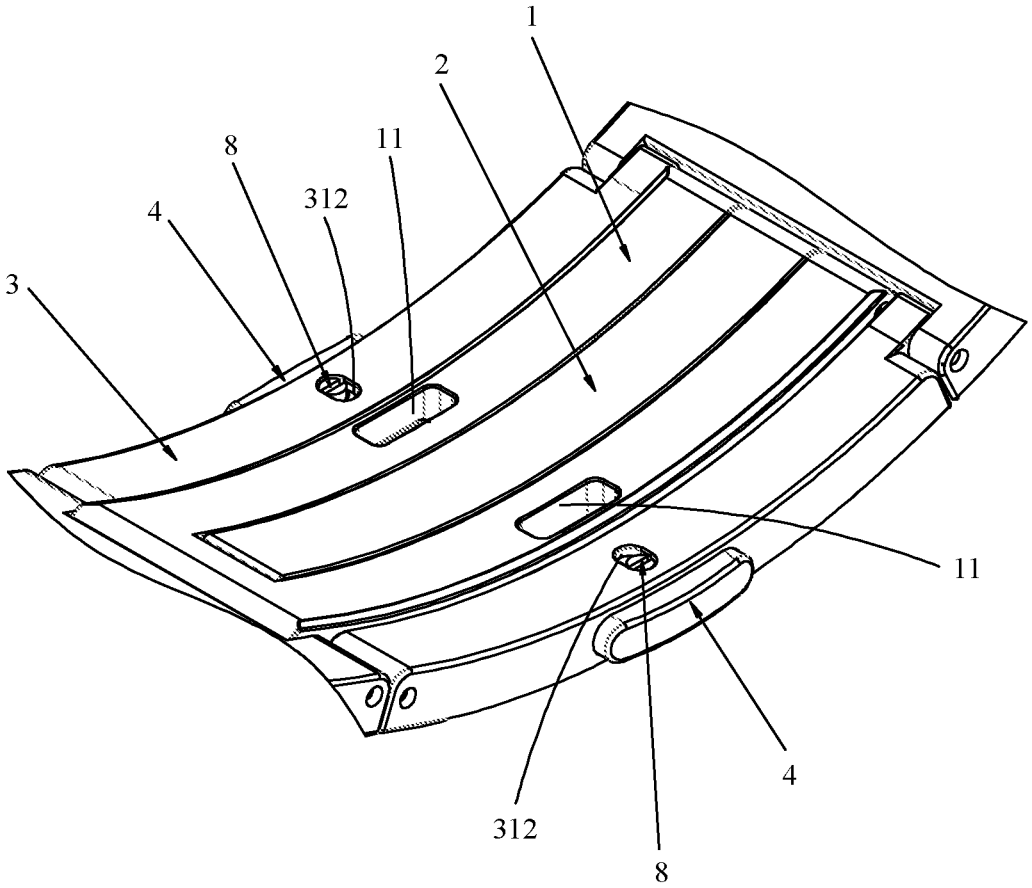
FIG. 15 is a schematic diagram of a structure of a position in which the watchband clasp in FIG. 11 is in contact with skin at a wrist.
Figure 16:
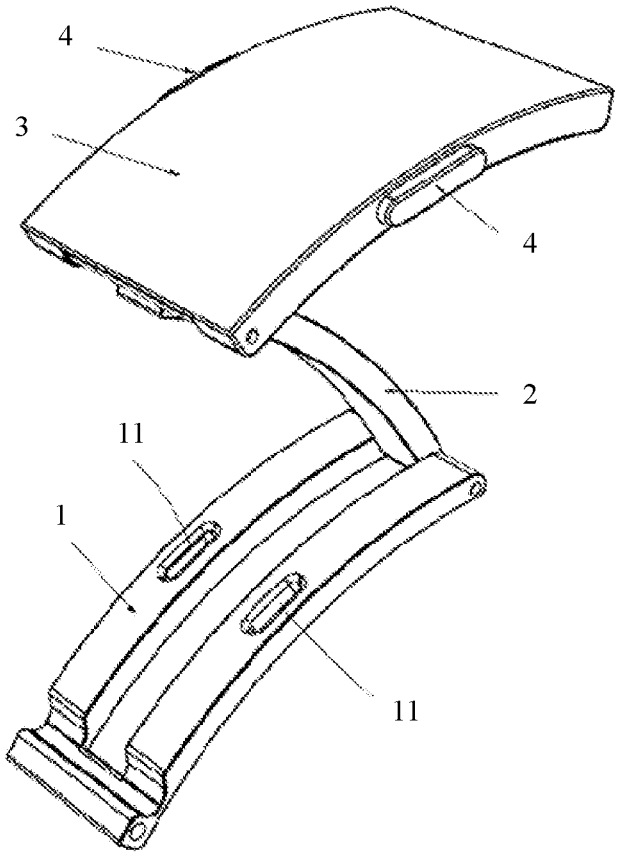
FIG. 16 is a schematic diagram of a structure at a viewing angle of the watchband clasp in FIG. 11 after the watchband clasp is released from a locked state (when the watchband clasp is released)
Figure 17:
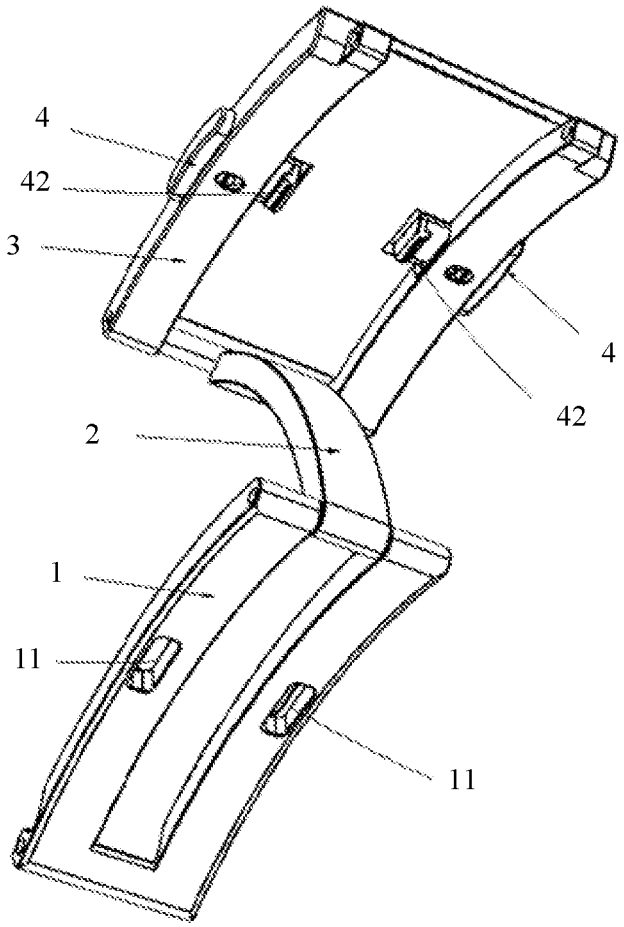
FIG. 17 is a schematic diagram of a structure at a viewing angle of the watchband clasp in FIG. 11 after the watchband clasp is released from a locked state (when the watchband clasp is released)

Refer to FIG. 13 and FIG. 14. In Embodiment 2, a limiting part is a second hook 111. A manner of clamping the hook member 4 to an inner wall of a hook hole 11 may be as follows: A first hook 42 of the hook member 4 extends into the hook hole 11 and is clamped to the second hook 111 on the inner wall of the hook hole 11. Under the action of the elastic member 5, a sliding plate 41 slides and drives the first hook 42 and the second hook 111 to remain in a reversely clamped state. In this case, the first hook 42 cannot move relative to the first fastener 1 in an axial direction of the hook hole 11, and this restricts rotation of the cover plate 3 relative to the first fastener 1, so that the watchband clasp 1000 remains in the locked state.

Refer to FIG. 13 and FIG. 14. In another specific implementation of the watchband clasp 1000 provided in this application, an included angle between an axis of a spring 51 and an axis of the hook hole 11 ranges from 85 degrees to 95 degrees (for example, is 90 degrees or approximately 90 degrees). Therefore, a force exerted by the spring 51 on the hook member 4 is not parallel to the axis of the hook hole 11, and the force exerted by the spring 51 on the hook member 4 necessarily has a component force in a direction perpendicular to the axis of the hook hole 11, so that the hook member 4 can be stably clamped to the inner wall of the hook hole 11. For example, the first hook 42 of the hook member 4 may be closely attached to the second hook 111 on the inner wall of the hook hole 11, to implement reverse clamping, so as to ensure a good clamped state, and implement stability of the watchband clasp 1000 in the locked state.

A difference between Embodiment 2 and Embodiment 1 is as follows: The sliding slot in Embodiment 2 is disposed on the side face 34 of the cover plate 3, but the sliding slot in Embodiment 1 is disposed on the rear face 33 of the cover plate 3. The limiting part in Embodiment 2 is the second hook 111, but the limiting part in Embodiment 1 is the clamping hole 112. Another technical feature of Embodiment 2 is the same as that of Embodiment 1, and details are not described herein.

Figure 18:
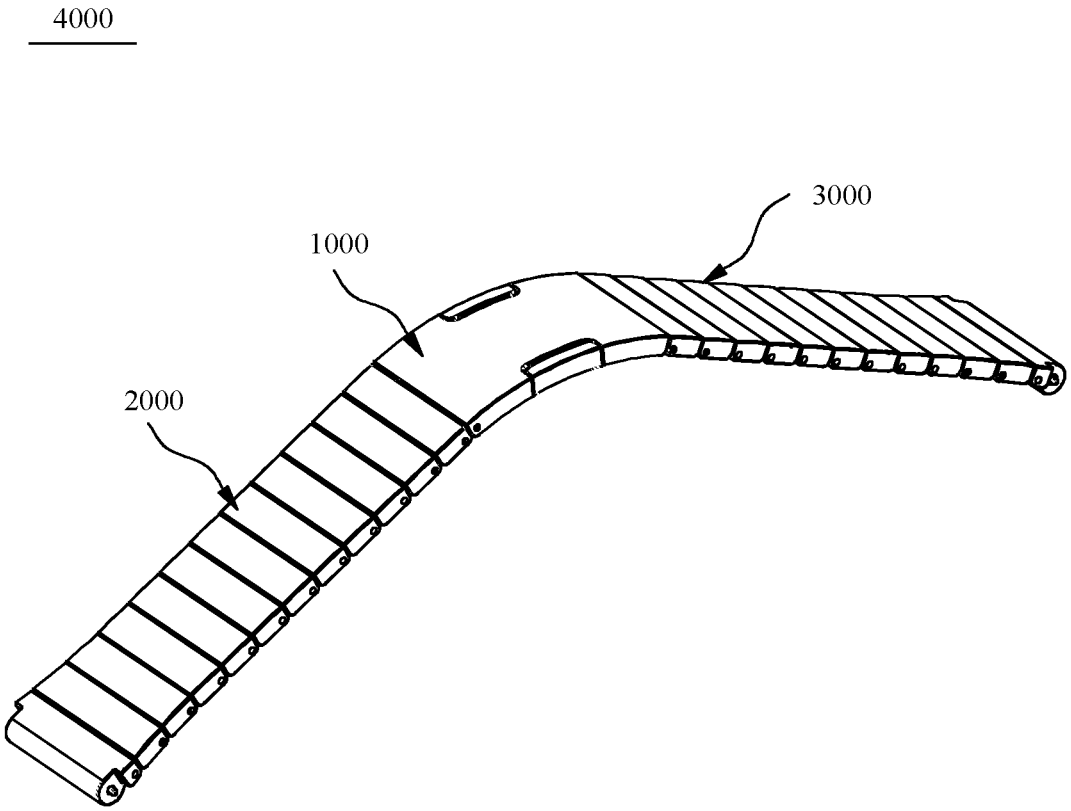
FIG. 18 shows a watchband that includes the watchband clasp in FIG. 2 in an embodiment of this application.
Figure 19:
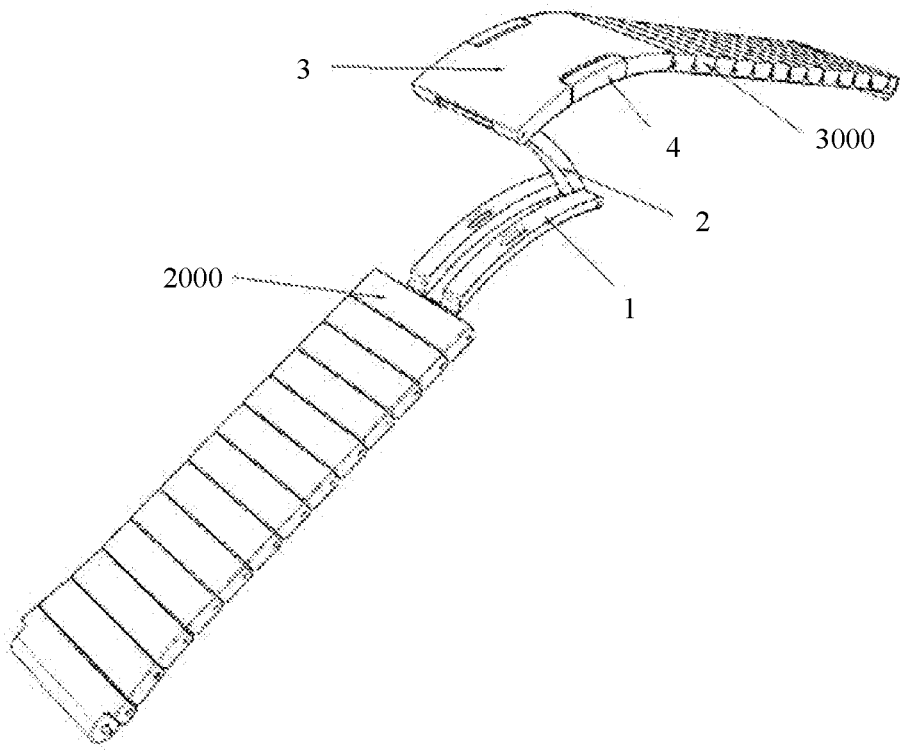
FIG. 19 is a schematic diagram of a structure of the watchband clasp of the watchband in FIG. 18 when the watchband clasp is released.
Figure 20:
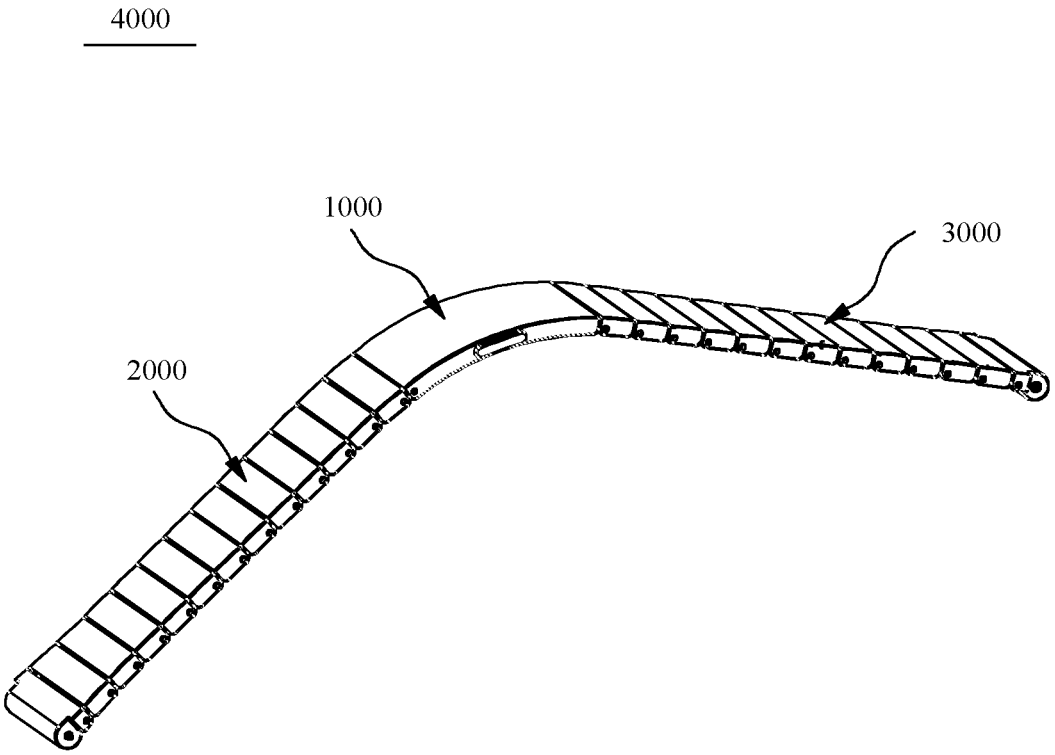
FIG. 20 shows a watchband that includes the watchband clasp in FIG. 11 in an embodiment of this application.

As shown in FIG. 18 to FIG. 20, an embodiment of this application provides a watchband 4000, including the watchband clasp 1000 in any one of the foregoing embodiments.

Figure 21:
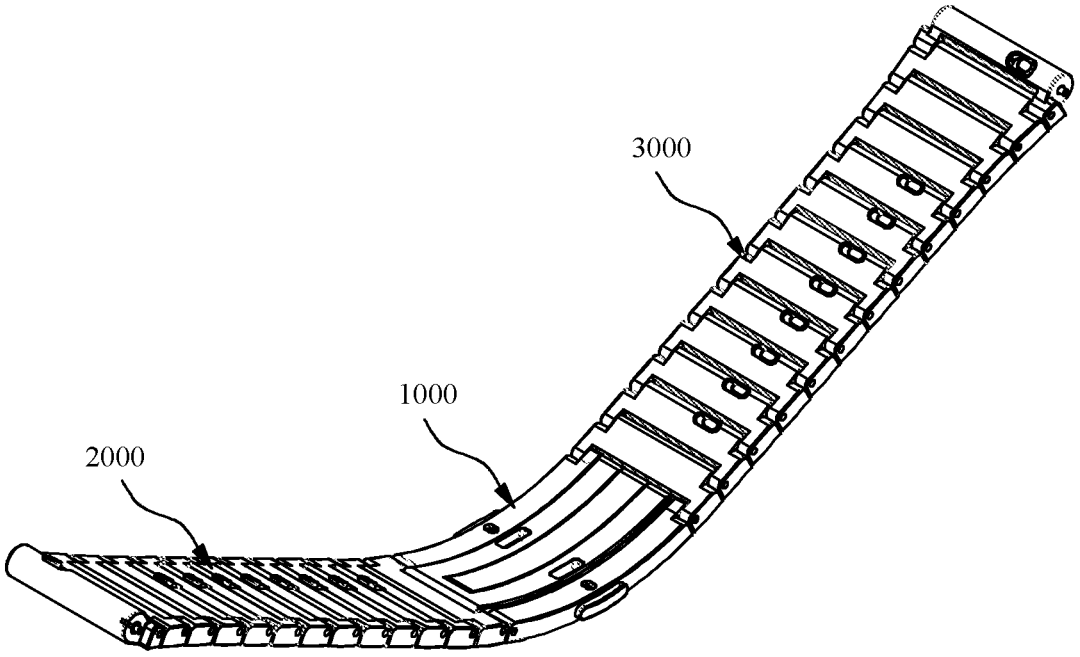
FIG. 21 is a schematic diagram of a structure of a position in which the watchband in FIG. 20 is in contact with skin at a wrist.
Figure 22:
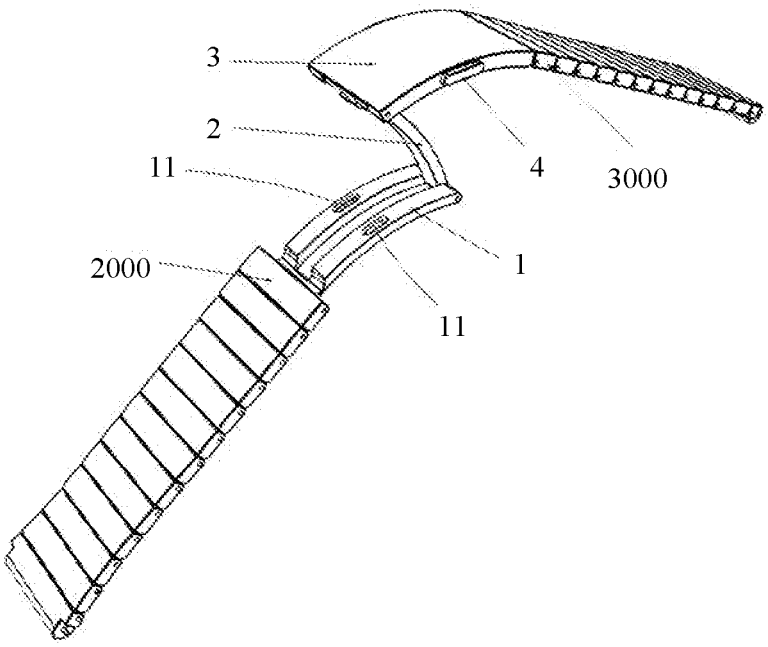
FIG. 22 is a schematic diagram of a structure of the watchband clasp of the watchband in FIG. 21 when the watchband clasp is released.

The watchband 4000 includes the watchband clasp 1000 in any one of the foregoing embodiments. When the watchband 4000 is worn on a wrist, a surface on a side that is of a first fastener 1 and that is away from a cover plate 3 is in contact with skin at the wrist. A hook member 4 slidably mounted on the cover plate 3 extends into a hook hole 11 on the first fastener 1 through a surface on a side that is of the first fastener 1 and that faces the cover plate 3, and is clamped to an inner wall of the hook hole 11, so that the cover plate 3 and the first fastener 1 are fastened to each other. As shown in FIG. 21 and FIG. 22, the hook member 4 does not protrude from the surface on the side that is of the first fastener 1 and that is away from the cover plate 3, that is, the first fastener 1 that is in contact with the skin at the wrist has no protrusion structure. Wearing comfort is not likely to be affected by a protrusion structure against the skin at the wrist.

In an embodiment, the watchband 4000 further includes a first watchband chain 2000 connected to the first fastener 1, and a second watchband chain 3000 connected to the cover plate 3.

The first watchband chain 2000 is connected (for example, rotatably connected) to the first fastener 1, and the second watchband chain 3000 is connected (for example, rotatably connected) to the second fastener 2. The first watchband chain 2000 and the second watchband chain 3000 each may include a plurality of chain units. Neighboring chain units are rotatably connected to each other, to adapt to wearing requirements of hands with different shapes.

For a watchband 4000 in another embodiment, the first fastener 1 and the cover plate 3 may be connected to a leathery band or a band made of a flexible high-molecular polymer.

For example, an overall material of the watchband 4000 may be a metal member or a plastic member.

In an embodiment, the watchband 4000 may be a metal member, and the watchband clasp 1000, the first watchband chain 2000, and the second watchband chain 3000 are all metal.

In another embodiment, the watchband 4000 may be a plastic member, the watchband clasp 1000 may be a rigid plastic member, and the first watchband chain 2000 and the second watchband chain 3000 may be flexible plastic members.

Figure 23:
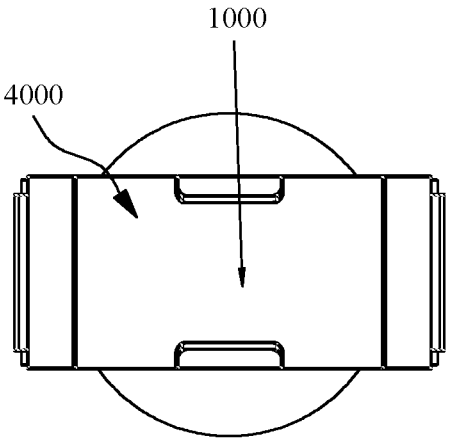
FIG. 23 is a schematic diagram of a structure of a wearable device according to an embodiment of this application.

As shown in FIG. 23, an embodiment of this application provides a wearable device, including the watchband 4000 in any one of the foregoing embodiments, and a component such as a crown mounted on the watchband 4000.

The wearable device may be a device such as a watch (a conventional watch or a smart watch) or a wristband. When the wearable device is worn on a wrist, a surface on a side that is of a first fastener 1 and that is away from a cover plate 3 is in contact with skin at the wrist. A hook member 4 slidably mounted on the cover plate 3 extends into a hook hole 11 on the first fastener 1 through a surface on a side that is of the first fastener 1 and that faces the cover plate 3, and is clamped to an inner wall of the hook hole 11, so that the cover plate 3 and the first fastener 1 are fastened to each other. Therefore, the hook member 4 does not protrude from the surface on the side that is of the first fastener 1 and that is away from the cover plate 3, that is, the first fastener 1 that is in contact with the skin at the wrist has no protrusion structure. Wearing comfort is not likely to be affected by a protrusion structure against the skin at the wrist.

It is clear that, the foregoing embodiments of this application are merely examples for clearly describing this application, but not limitation on the implementations of this application. A person of ordinary skill in the art may make other different forms of modifications or changes based on the foregoing descriptions. All implementations do not need to and cannot be exhaustively listed herein. Any modification, equivalent replacement, and improvement made without departing from the spirit and principle of this application should fall within the protection scope of the claims of this application.

What is claimed is:

1. A watchband clasp, comprising:

a first fastener, provided with a first hook hole and a second hook;

a second fastener, rotatably connected to the first fastener;

a cover plate, rotatably connected to an end of the second fastener away from the first fastener, wherein the cover plate is provided with a first accommodation slot that can accommodate at least most of the first fastener and at least most of the second fastener within the first accommodation slot;

a first hook member and a second hook member, wherein the first hook member is configured to be received in the first hook hole, the second hook member is configured to be received in the second hook hole, and wherein the first hook member and the second hook member are slidably mounted on the cover plate; and a first elastic member and a second elastic member, wherein the first elastic member is mounted between the cover plate and the first hook member, wherein the second elastic member is mounted between the cover plate and the second hook member, wherein in a free state the first elastic member can enable the first hook member to maintain a clamped state with an inner wall of the first hook hole and the second elastic member can enable the second hook member to maintain a clamped state with an inner wall of the second hook hole, the clamped state with the first hook hole can be released after an external force drives the first hook member to slide relative to the cover plate, the clamped state with the second hook hole can be released after an external force drives the second hook member to slide relative to the cover plate, and at least a portion of the first accommodation slot is between the first elastic member and the second elastic member.

2. The watchband clasp according to claim 1, wherein the first hook member comprises a first sliding plate slidably mounted on the cover plate and a first hook connected to the first sliding plate, a first limiting part movably connected to the first hook is disposed in the first hook hole, and the first limiting part can restrain the first hook from leaving the first hook hole in a depth direction of the first hook hole;

wherein the second hook member comprises a second sliding plate slidably mounted on the cover plate and a third hook connected to the second sliding plate, a second limiting part movably connected to the third hook is disposed in the second hook hole, and the second limiting part can restrain the third hook from leaving the second hook hole in a depth direction of the second hook hole.

3. The watchband clasp according to claim 2, wherein the first limiting part is a second hook adapted to the first hook, or the first limiting part is a first clamping hole disposed on the inner wall of the first hook hole and adapted to the first hook;

wherein the second limiting part is a fourth hook adapted to the third hook, or the second limiting part is a second clamping hole disposed on the inner wall of the second hook hole and adapted to the third hook.

4. The watchband clasp according to claim 3, wherein the cover plate is provided with a first sliding slot and a second sliding slot, the first hook member is slidably mounted in the first sliding slot, the second hook member is slidably mounted in the second sliding slot, an inner wall of the first sliding slot is provided with a first spacing hole, and an inner wall of the second sliding slot is provided with a second spacing hole, the first hook member further comprises a first connection plate connected between the first hook and the first sliding plate, the first connection plate penetrates through the first spacing hole, and there is a first included angle between the first hook and the first connection plate;

the second hook member further comprises a second connection plate connected between the second hook and the second sliding plate, the second connection plate penetrates through the second spacing hole, and there is a second included angle between the third hook and the second connection plate.

5. The watchband clasp according to claim 4, wherein the cover plate has a rear face, a front face, and a side face connected between the front face and the rear face, the first and second sliding slots disposed on the rear face or the side face, and both the rear face and the front face at least partially covering the second fastener.

6. The watchband clasp according to claim 5, wherein the first accommodation slot is disposed on the front face, and the first and second spacing holes are connected to the first accommodation slot.

7. The watchband clasp according to claim 6, wherein two first rotation holes are disposed on two opposite inner walls of the first accommodation slot, the second fastener is provided with a second rotation hole, a first rotating connection shaft is disposed between the second fastener and the cover plate, the first rotating connection shaft penetrates through the second rotation hole, and two opposite ends of the first rotating connection shaft are separately rotatably mounted in the two first rotation holes.

8. The watchband clasp according to claim 7, wherein the second fastener has a rotation cylinder, the rotation cylinder is provided with the second rotation hole, and the first fastener is provided with a second accommodation slot configured to receive the rotation cylinder.

9. The watchband clasp according to claim 1, wherein the first fastener is provided with an accommodation hole configured to accommodate the second fastener, and a depth of the accommodation hole is greater than or equal to a thickness of the second fastener.

10. The watchband clasp according to claim 9, wherein two third rotation holes are disposed on two opposite inner walls of the accommodation hole, a fourth rotation hole is disposed on the second fastener, a second rotating connection shaft is disposed between the first fastener and the second fastener, the second rotating connection shaft penetrates through the fourth rotation hole, and two opposite ends of the second rotating connection shaft are separately rotatably mounted in the two third rotation holes.

11. The watchband clasp according to claim 4, wherein the inner wall of the first sliding slot is provided with a first limiting waist-shaped hole, a first limiting connector is disposed between the first hook member and the cover plate, the first limiting connector penetrates through the first limiting waist-shaped hole and is fixedly connected to the first hook member, a first length and a first width of the first limiting waist-shaped hole are greater than an outer diameter of the first limiting connector, and there is a third included angle between an axis of the first limiting waist-shaped hole and an axis of the first spacing hole; and wherein the inner wall of the second sliding slot is provided with a second limiting waist-shaped hole, a second limiting connector is disposed between the second hook member and the cover plate, the second limiting connector penetrates through the second limiting waist-shaped hole and is fixedly connected to the second hook member, a second length and a second width of the second limiting waist-shaped hole are greater than an outer diameter of the second limiting connector, and there is a fourth included angle between an axis of the second limiting waist-shaped hole and an axis of the second spacing hole.

12. The watchband clasp according to claim 1, wherein the first hook member is provided with a first mounting slot, one end of the first elastic member abuts against the bottom of the first mounting slot, and the other end of the first elastic member abuts against the cover plate; and wherein the second hook members is provided with a second mounting slot, one end of the second elastic member abuts against the bottom of the second mounting slot, and the other end of the second elastic member abuts against the cover plate.

13. The watchband clasp according to claim 1, wherein there is a fifth included angle between an axis of the first elastic member and an axis of the first hook hole; and wherein there is a sixth included angle between an axis of the second elastic member and an axis of the second hook hole.

14. A watchband, comprising the watchband clasp according to claim 1.

15. A wearable device, comprising the watchband according to claim 14.

* * * * *